US010668996B2

(12) United States Patent
Nedumaran et al.

(10) Patent No.: US 10,668,996 B2
(45) Date of Patent: Jun. 2, 2020

(54) LNG CARRIER CONSTRUCTION METHOD

(71) Applicant: KEPPEL OFFSHORE & MARINE TECHNOLOGY CENTRE PTE LTD, Singapore (SG)

(72) Inventors: Asok Kumar Nedumaran, Singapore (SG); Wen Sin Chong, Singapore (SG); Kok Seng Foo, Singapore (SG)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 582 days.

(21) Appl. No.: 14/764,367

(22) PCT Filed: Jan. 29, 2013

(86) PCT No.: PCT/SG2013/000036
§ 371 (c)(1),
(2) Date: Jul. 29, 2015

(87) PCT Pub. No.: WO2014/120080
PCT Pub. Date: Aug. 7, 2014

(65) Prior Publication Data

US 2015/0367915 A1 Dec. 24, 2015

(51) Int. Cl.
*B63B 83/00* (2020.01)
*B63B 3/04* (2006.01)
(Continued)

(52) U.S. Cl.
CPC ..... *B63B 83/00* (2020.01); *B63B 3/04* (2013.01); *B63B 25/12* (2013.01); *B63B 25/14* (2013.01); *B63B 25/16* (2013.01)

(58) Field of Classification Search
CPC .... B63B 9/04; B63B 9/00; B63B 3/04; B63B 25/16; B63B 25/14; B63B 25/12
(Continued)

(56) References Cited

U.S. PATENT DOCUMENTS 3,397,663 A * 8/1968 Ito ..... B63B 9/04 114/77 R
6,176,193 B1 * 1/2001 Whitby ..... B63B 9/04 114/230.12
2003/0159800 A1 * 8/2003 Nierenberg ..... F17C 5/06 165/41

FOREIGN PATENT DOCUMENTS

EP 2228294 A1 9/2010
EP 2412624 A1 2/2012
(Continued)

OTHER PUBLICATIONS

"New Midsection for Vessel: Cargo Ship's Shape Gets Overhaul", Gerald Faris, LA Times, Apr. 16, 1987.*
(Continued)

*Primary Examiner* — Anthony D Wiest
(74) *Attorney, Agent, or Firm* — John P. White; Cooper & Dunham LLP

(57) ABSTRACT

A structural block is fabricated with necessary components and structure for LNG storage and/or process. The structural block may be an LNG tank with the same configuration as that in an LNG carrier. The structural block may also be a regasification plant or a liquefaction plant to be used for LNG process. An existing vessel, e.g. an LNG carrier, is cut apart to form a forward section and an aft section. The forward section and the aft section are moved away from each other to form a space therebetween. The structural block is then placed into the space and jointed to the forward and aft sections, by welding for example, to form an integrated new vessel. The structural block provides the new vessel with increased LNG storage and transportation capabilities as well as regasification and/or liquefaction process facilities to meet the increased demand for LNG storage, transportation and processing.

17 Claims, 22 Drawing Sheets

(51) Int. Cl.
*B63B 25/12* (2006.01)
*B63B 25/16* (2006.01)
*B63B 25/14* (2006.01)

(58) Field of Classification Search
USPC ..... 114/74 A, 77 R, 77 A
See application file for complete search history.

(56) References Cited

FOREIGN PATENT DOCUMENTS

| | | | |
|---|---|---|---|
| JP | S54146398 | A | 11/1979 |
| RU | 2433060 | C1 | 11/2011 |
| WO | WO 2005/056377 | A2 | 6/2005 |
| WO | WO 2005/113328 | A1 | 12/2005 |

OTHER PUBLICATIONS

"Pictured: The 'cut-and-shut' cruise ship that was sliced in half to add more rooms", Neil Sears, Daily Mail, Aug. 25, 2008.*
International Search Report, dated May 15, 2013 in connection with PCT International Application No. PCT/SG2013/000036, filed Jan. 29, 2013.
Notification of Transmittal of International Preliminary Report on Patentability (Chapter II of the Patent Cooperation Treaty), including an International Preliminary Report on Patentability, dated Dec. 18, 2014 by the International Preliminary Examining Authority (IPEA/AU) in connection with PCT International Application No. PCT/SG2013/000036, filed Jan. 29, 2013.

* cited by examiner

LNG CARRIER CONSTRUCTION METHOD

CROSS-REFERENCE TO RELATED APPLICATIONS

This application is a § 371 national stage of PCT International Application No. PCT/SG2013/000036, filed Jan. 29, 2013, the entire contents of which are hereby incorporated by reference.

TECHNICAL FIELD

The present invention relates to a method for vessel construction and in particular, to a method for vessel modification to increase the storage and/or deck space capacity of existing vessels to serve similar or a different purposes.

BACKGROUND

There are existing Liquid Natural Gas (LNG) Carriers in the market serving as LNG transportation vessels, and some of them are approaching the end of the charterer period, and/or available for life-extension program for continuous services as the LNG Carriers or other purposes. LNG Carriers are usually well-maintained vessel and in particularly the LNG storage tanks are still at good conditions. These existing carriers are mainly of 4 types of containment systems:

1) IGC Independent Tank Type-B MOSS System (Spherical Dome)
2) IGC Independent Tank Type-B SPB System (IHI)
3) Membrane Type LNG Containment System (GTT)
4) IGC Independent Tank Type-C Pressurized System Similar to FPSO conversion from crude oil tanker, there are markets for these existing LNG carriers to be converted into offshore or near-shore oil and gas processing facilities, such as LNG export or import facilities, as they term as FLNG (Floating Liquefied Natural Gas) units and FSRU (Floating Storage & Regasification Unit).

However, some of these existing LNG carriers have their limitation to be redeployed for these purposes and thus there exists a need for technical solutions. Some of these limitations are related to lacking of available space and/or storage capacities on existing LNG carrier to better serve its new purposes. For example, MOSS Type LNG carriers has very limited deck space available for more gas processing facilities, and this imposes limitation for its suitability to be converted into FLNG; some of the earlier generation of LNG carriers are also lesser in LNG storage capacities, e.g. below 130,000 $m^3$ which are less ideal as FSRU receiving terminal.

As for existing LNG carriers, these vessels have been optimized to have maximum storage and transportation efficiency. Existing LNG carriers have fully utilized the available space of the vessel for the LNG storage tanks, hence there is no enough space to further increase the storage capacity on a given vessel. In addition, such vessels do not have facilities required to process the LNG, e.g. the regasification process facility and/or liquefaction process facility, as these are conventionally carried out at the offshore or near shore terminals. These existing LNG carriers are also usually less efficient than the newer generation bigger LNG carriers, which are built with larger LNG storage capacities with higher transportation efficiencies. This also means that the older and smaller capacity yet still functional vessels are at competitive disadvantage even if they continue to function for LNG transportation as compare with the newer generation of LNG carriers. These existing LNG carriers may be converted to be used as FLNG or FSRU, however in some cases, limited due to storage space constraints.

SUMMARY OF THE INVENTION

To meet higher LNG storage capacity requirement and deck space for additional gas processing facilities, an added structural section is proposed to be integrated with the existing LNG carriers, for additional storage and deck space requirement.

Embodiments of the present invention provide solutions for existing LNG carriers to be reused for LNG storage and transportation beyond their original capacity. In addition, embodiments of the present invention provide solutions to enable existing LNG carriers to perform LNG process functions such as regasification and/or liquefaction.

According to one embodiment, a structural block is prefabricated with necessary full set or partial set of the components and structure for LNG storage and/or treatment processes. The structural block may contain one or more LNG tank(s) with the same or different configuration or containment system as that of the existing LNG carrier. For example, where the existing LNG carrier is a MOSS type LNG carrier, the added LNG storage can be either MOSS, or other types, i.e. Membrane, SPB or Type-C tanks. The structural block may also contain a regasification plant or a liquefaction plant with related gas processing plant and function as FLNG or FSRU together with the LNG storage tanks on the vessel. The structural block can be part of second existing LNG carrier which may contain LNG tank with the same or different configuration or containment system as that of the first existing LNG carrier. In this case only LNG tank from second existing LNG carrier can utilize with new structural block but hull structure should match as per the first existing LNG carrier.

An existing LNG carrier is cut apart to form a forward section and an aft section. The fabrication of the new structural block may be carried out at a shipyard, but during the fabrication of the structural block, the LNG vessel needs not be present at the shipyard. Alternatively, fabrication of the structural block may be carried out at a workshop or a fabrication area, which is independently operable from a shipyard used for cutting the LNG carrier. In either situation, this will allow the LNG carriers to continue to operate as LNG transportation vessel, during the structural block fabrication period. One or more structural blocks may be fabricated based on optimized working schedule, construction sequence and coordination with the LNG carrier work process.

Upon near completion of the structural block, the existing LNG carrier will be dry-docked for cutting of the hull for vessel assembly. When the existing hull is separated into forward and aft sections, either one or both sections are moved away from each other to form a space there between. The new structural block is then placed into the space and jointed to the forward and aft sections, by welding for example, to form an integrated new vessel. The structural block provides the new vessel with increased LNG storage and space capacity, to meet the increased demand or new functions. In embodiments where the structural block includes a regasification plant and/or liquefaction plant, relevant LNG-process functions are added to the existing LNG carrier which originally possesses only the LNG storage and transportation capabilities.

Embodiments of the present invention can provide the following advantages:

1) The existing vessels are only needed during vessel assembly period in the yard, which minimizes the period for the vessel to be present in a shipyard. This will maximize the utililization of the LNG Carriers;
2) The new integrated vessel can still be functional as LNG Carrier, and at the same time capable of utilizing it as FLNG or FSRU. This makes the new units flexible for multiple deployment, for example LNG-RV (LNG Regasification Vessel) which can cross function as FSRU and as LNG Carriers.
3) The new integration vessel contains different LNG containment systems, which may give further advantage to allow deck-space, and/or flexibility in terms of cargo operation. For example, they may serve as pressurized storage tanks for better BOG (Boil-off-Gas) handling.
4) This may also allow the new structure block and vessel assembly to be done separately at most effective arrangement, and transported for final integration. The new structure block with LNG processes (Liqufaction and/or Regasification) with related gas processing modules maybe able to be fully tested and commissioned, as much as possible, prior to cutting of the vessel. This allows added advantage to reduce risk and unnecessary downtime of the LNG carriers.

Other aspects and advantages of the present invention will become apparent from the following detailed description, illustrating by way of example the inventive concept of the present invention.

BRIEF DESCRIPTION OF THE DRAWINGS

These and other aspects of the present invention will be described in detail with reference to the accompanying drawings, in which.

DETAILED DESCRIPTION OF PREFERRED EMBODIMENTS

Figure 1A:
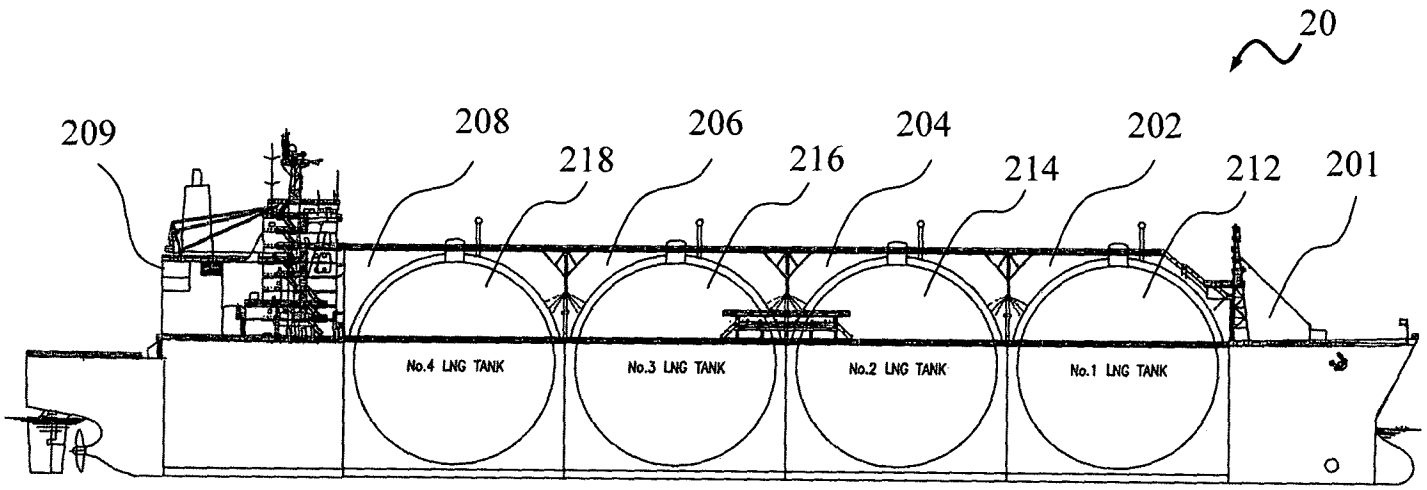
FIG. 1A is a partial cross sectional side view of an existing LNG carrier.
Figure 1B:
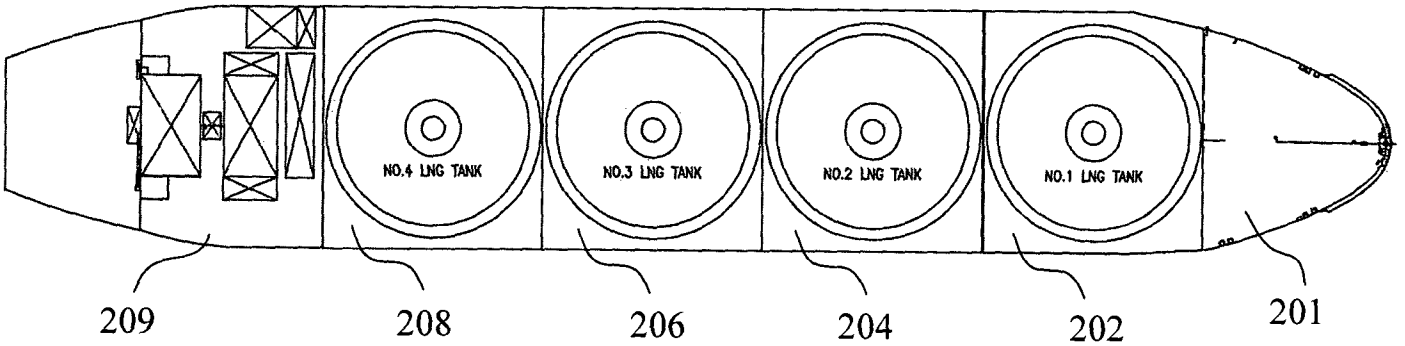
FIG. 1B is a partial top view of FIG. 1A.

FIGS. 1A and 1B show an existing LNG carrier 20 based on which a method of vessel construction according to one embodiment of the present invention may be applied. Existing LNG Carrier 20 includes a bow 201, a stern 209 and a midship between bow 201 and stern 209. The midship includes four segments 202, 204, 206 and 208. Each segment has a corresponding first, second, third and fourth LNG tank 212, 214, 216, 218 built therein. Each individual LNG tank has its fixed storage capacity and hence the total storage and transportation capacity of the vessel is the sum capacity of all the individual LNG tanks.

Figure 1C:
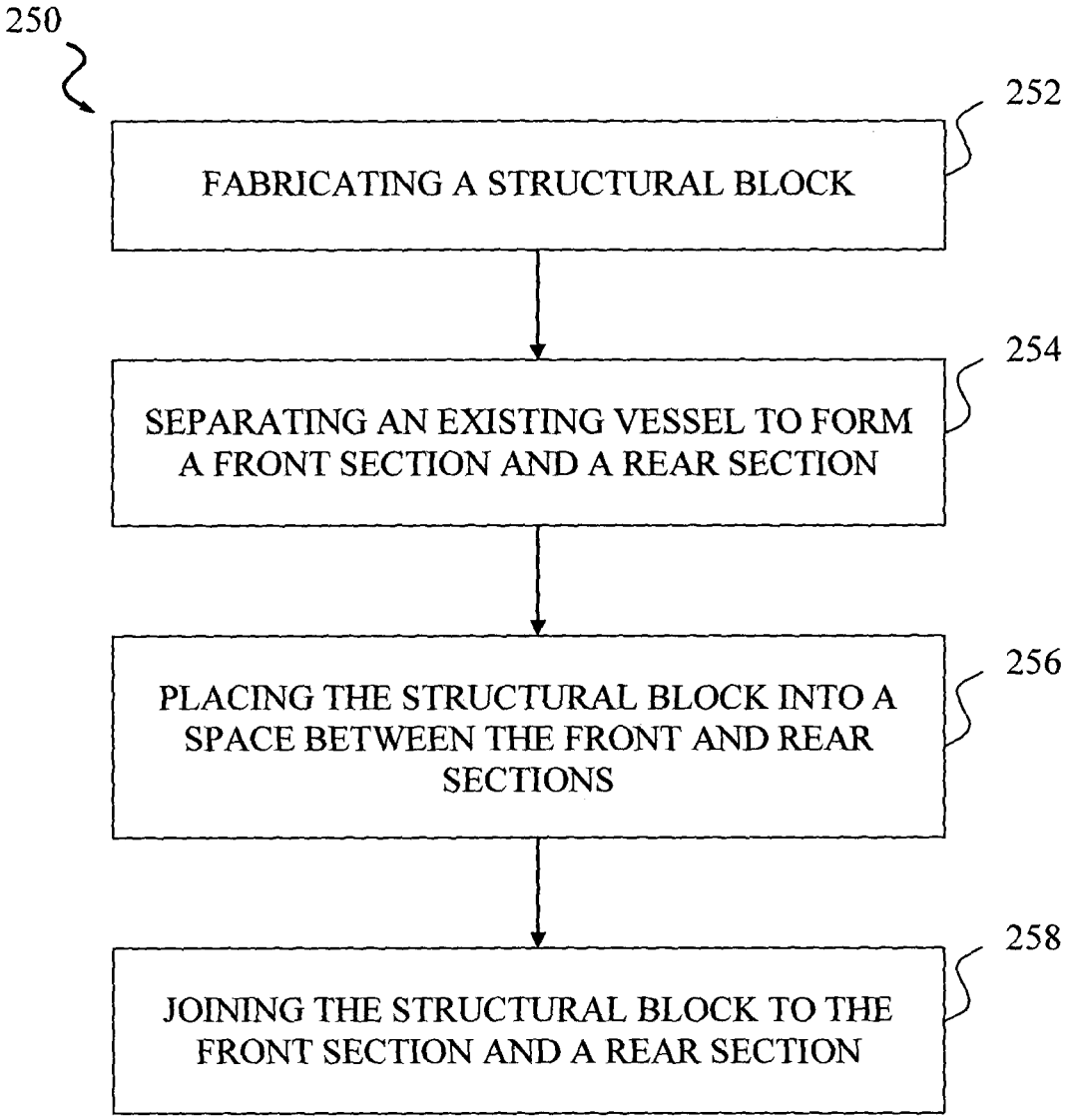
FIG. 1C is a block diagram showing a method of LNG carrier construction according to one embodiment of the present invention.

In a method 250 for constructing an LNG carrier according to one embodiment of the present invention, as shown in FIG. 1C, a structural block is fabricated (block 252) or provided as a prefabricated unit from other sources. An existing LNG Carrier is cut apart into a forward section and an aft section (block 254). The structural block is placed into a space formed between the forward section and the aft section (block 256) and then the structural block is jointed to the forward and aft sections (block 258) to form an integrated new LNG carrier.

Before an existing LNG carrier is cut, measurements and/or site inspections may be carried out to determine the characteristics of the existing LNG carrier, e.g. the dimensions, piping/cable layouts/configurations, hook-up points and connection interfaces, etc. Such information may be used for the fabrication of the structural block to ensure compatibility. In situations where such information is available, e.g. from previous measurements/inspections, it may be used directly for the fabrication of the structural block.

Further details of this and other embodiments will be illustrated below in conjunction with drawings.

Figure 2A:
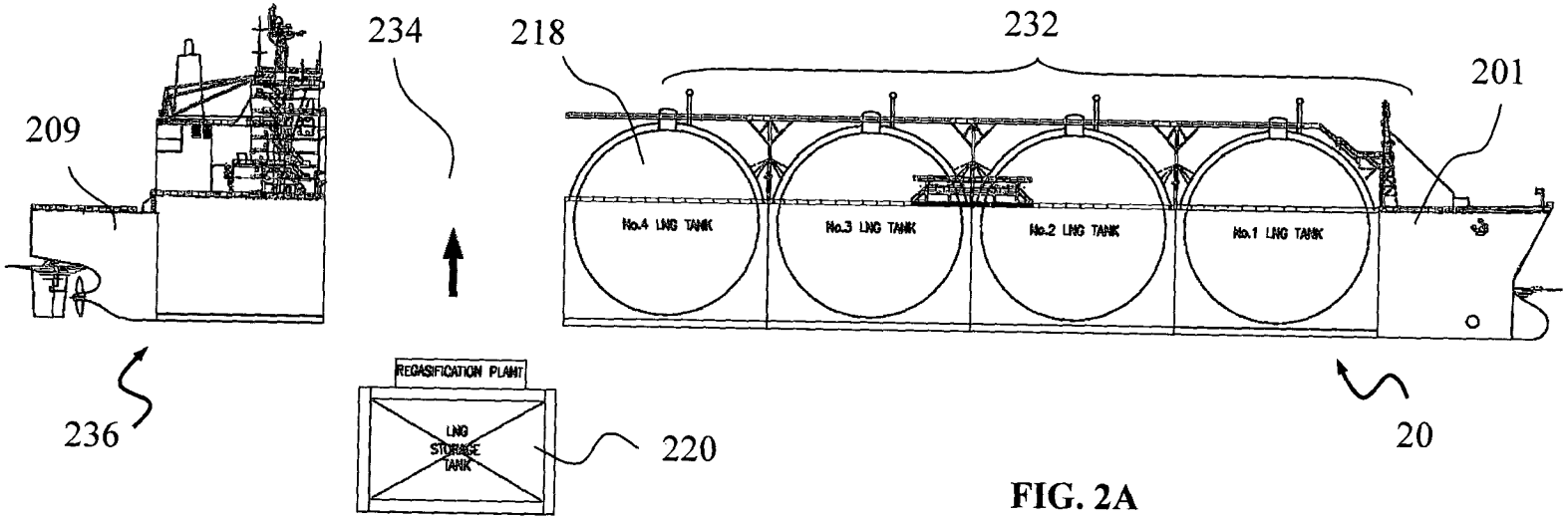
FIG. 2A is a partial cross sectional side view showing construction of an LNG carrier using an existing LNG carrier of FIG. 1A according to one embodiment of the present invention.
Figure 2B:
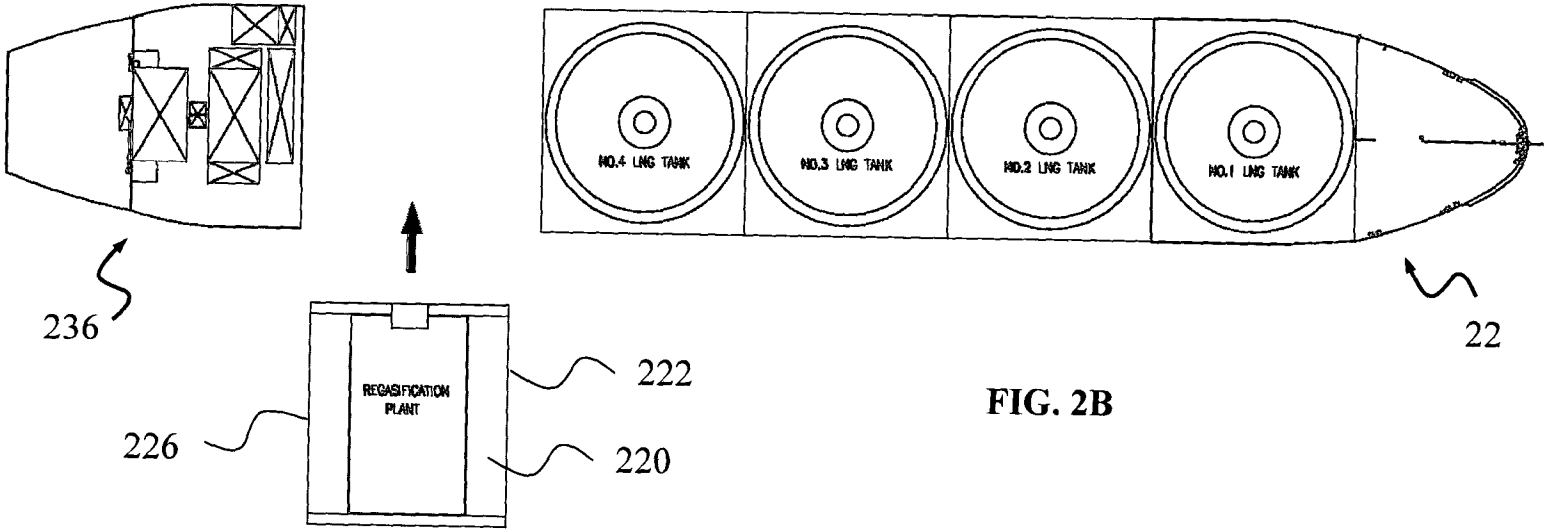
FIG. 2B is a partial top view of FIG. 2A.

As shown in FIGS. 2A and 2B, a structural block 220, e.g. an LNG storage tank, a regasification plant or both, is fabricated at a first site, e.g. a fabrication plant. During the fabrication of the structural block 220, a second site e.g. in this case a shipyard dock can perform its normal operations without being affected by the structural block fabrication. When the structural block fabrication is completed, an existing LNG carrier e.g. existing LNG carrier 20 may be brought to the shipyard dock, and separated by e.g. cutting. Alternatively, the structural block may be fabricated at the same side as that used to cut the existing vessel, e.g. a shipyard dock or fabrication site, but the existing vessel needs not be present during the fabrication. When fabrication of the structural block is completed, the existing vessel can dry dock to undergo the cutting and vessel assembly process.

Figure 2C:
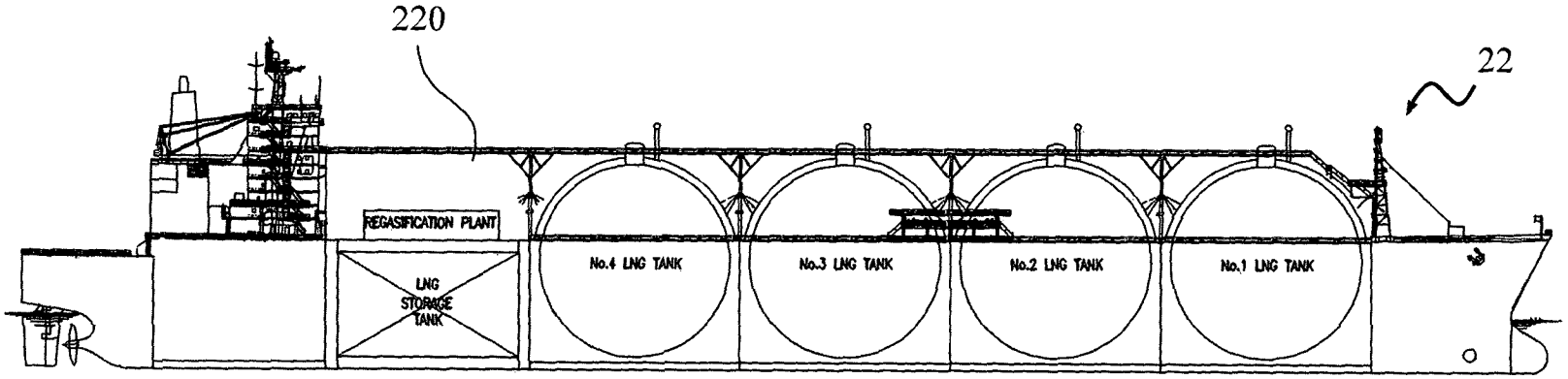
FIG. 2C is a partial cross sectional side view of a LNG carrier constructed according to the method shown in FIGS. 2A and 2B.
Figure 2D:
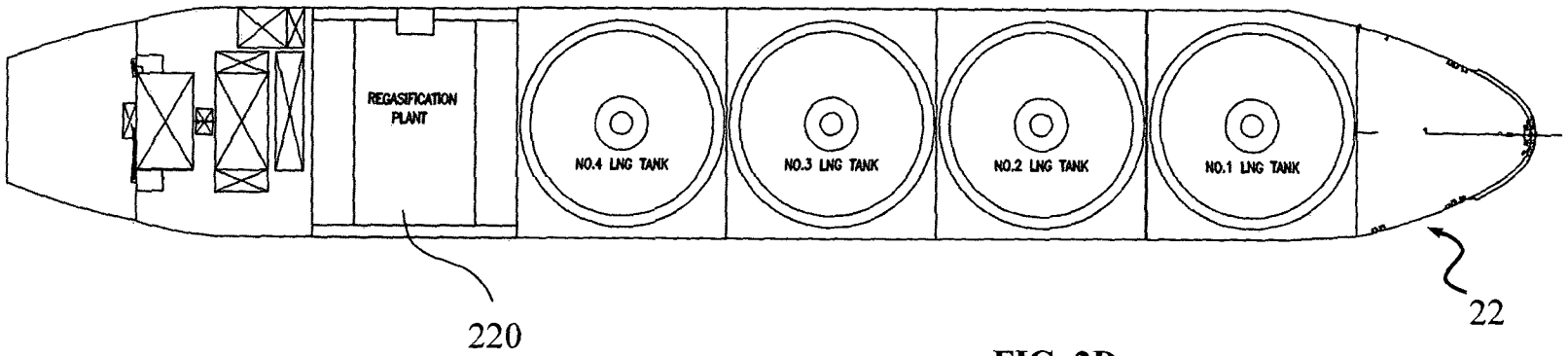
FIG. 2D is a partial top view of FIG. 2C.

In the embodiment shown in FIGS. 2A and 2B, cutting is performed between stern 209 and the fourth LNG tank 218, forming a forward section 232 which includes bow 201, first LNG tank 212, second LNG tank 214, third LNG tank 216 and fourth LNG tank 218, and an aft section 236 which is the stern 209. A space 234 is formed between forward section 232 and aft section 236. Structural block 220 is then placed in space 234 by floating or heave lift crane, with the forward section 232 jointed to front end 222 of structural block 220 and the aft section 236 jointed to rear end 226 of structural block 220. Upon joining, the structural block 220 together with the forward section 232 and aft section 236, form a new vessel 22 with the structural block 220 integrated to the existing LNG carrier, as shown in FIGS. 2C and 2D.

The LNG tank integrated into the structural block 220 may be the same type and configuration as that in the existing vessel. Such tank may be selected from a group consisting of a MOSS type tank, a Gaztransport & Technigaz (GTT) tank, a self-supporting prismatic type B (SPB) tank, an independent type A tank and an independent type C tank.

Building an FSRU or FLNG by utilizing an existing, smaller capacity LNG carrier, embodiments of the present invention provides new integrated vessels having lengthened hull with increased LNG storage and space capacity and/or added LNG process capability. Relevant industrial demand can be met with a much shorter delivery schedule than that required to build a new vessel from sketch, and with a greatly reduced CAPEX (Capital Expenditure). Embodiments of the present invention also enable reviving of existing, small-capacity LNG carriers which contributes to further cost-effective of the overall economics.

Figure 3A:
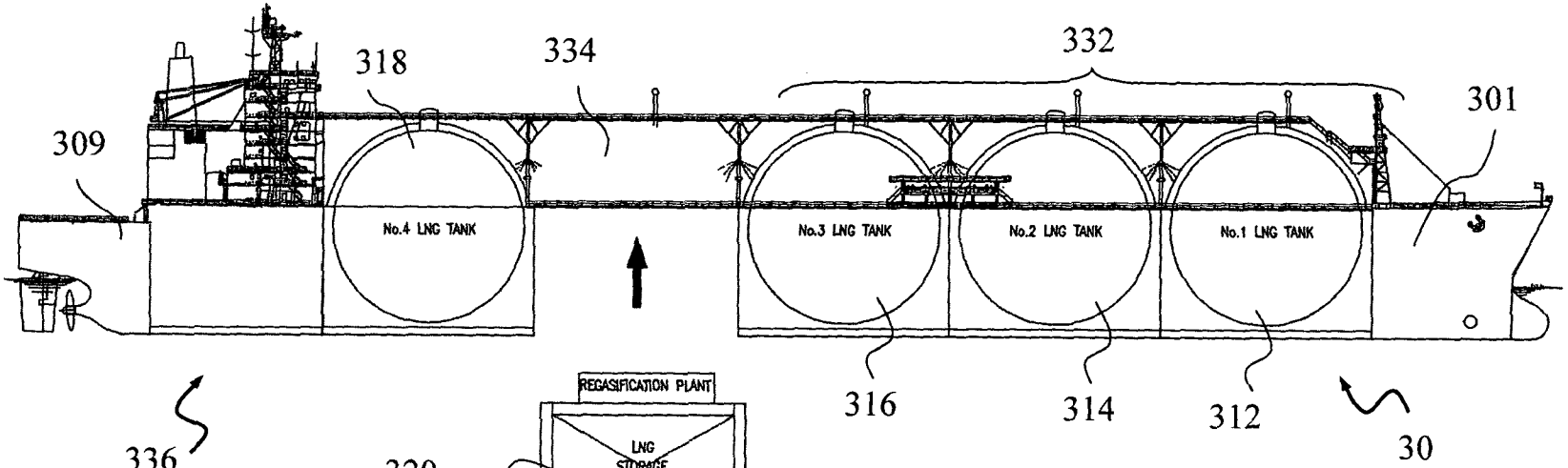
FIG. 3A is a partial cross sectional side view showing construction of an LNG carrier using an existing LNG carrier of FIG. 1A according to an alternative embodiment of the present invention.
Figure 3B:
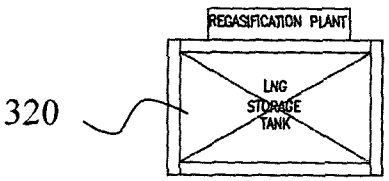
FIG. 3B is a partial top view of FIG. 3A.
Figure 3B:
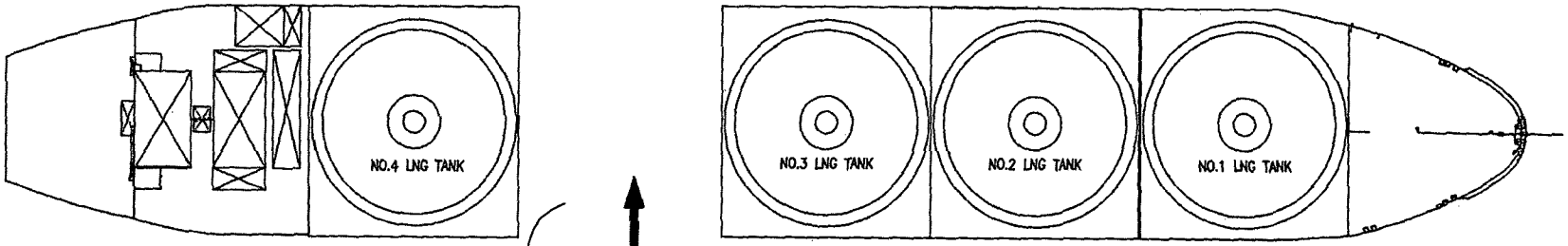
Figure 3B:
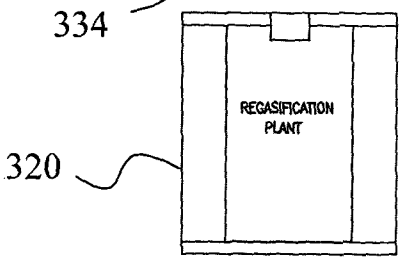
Figure 3C:
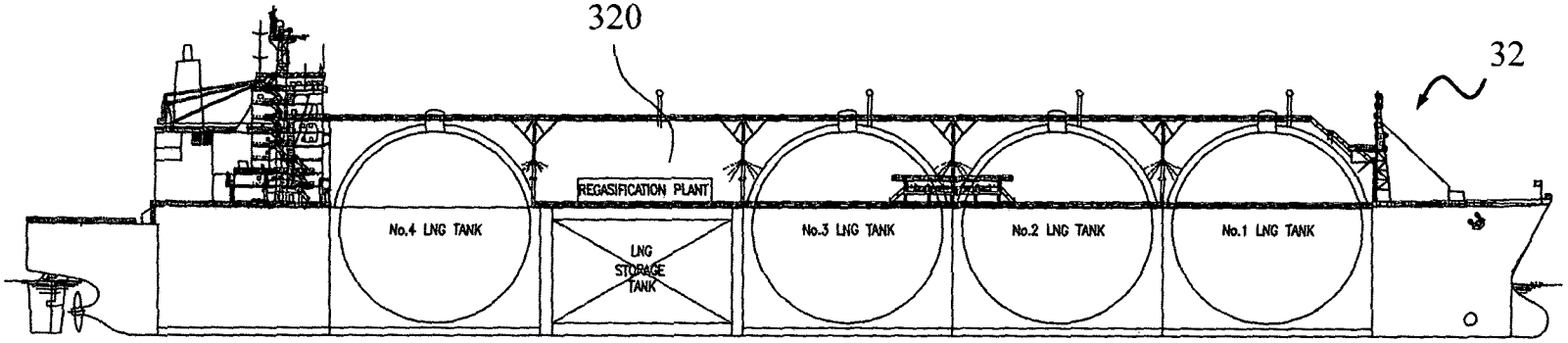
FIG. 3C is a partial cross sectional side view of an LNG carrier constructed according to the method shown in FIGS. 3A and 3B.
Figure 3D:
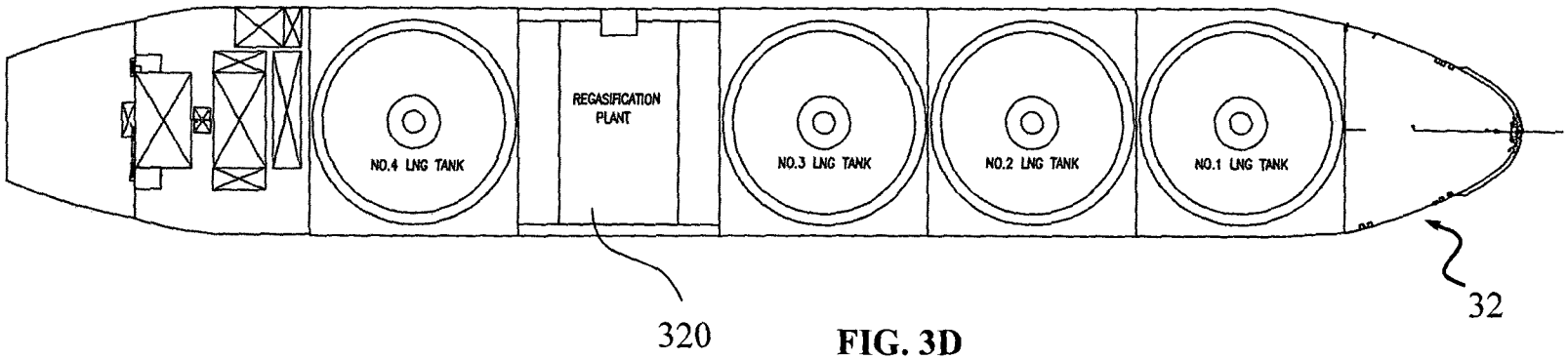
FIG. 3D is a partial top view of FIG. 3C.
Figure 4A:
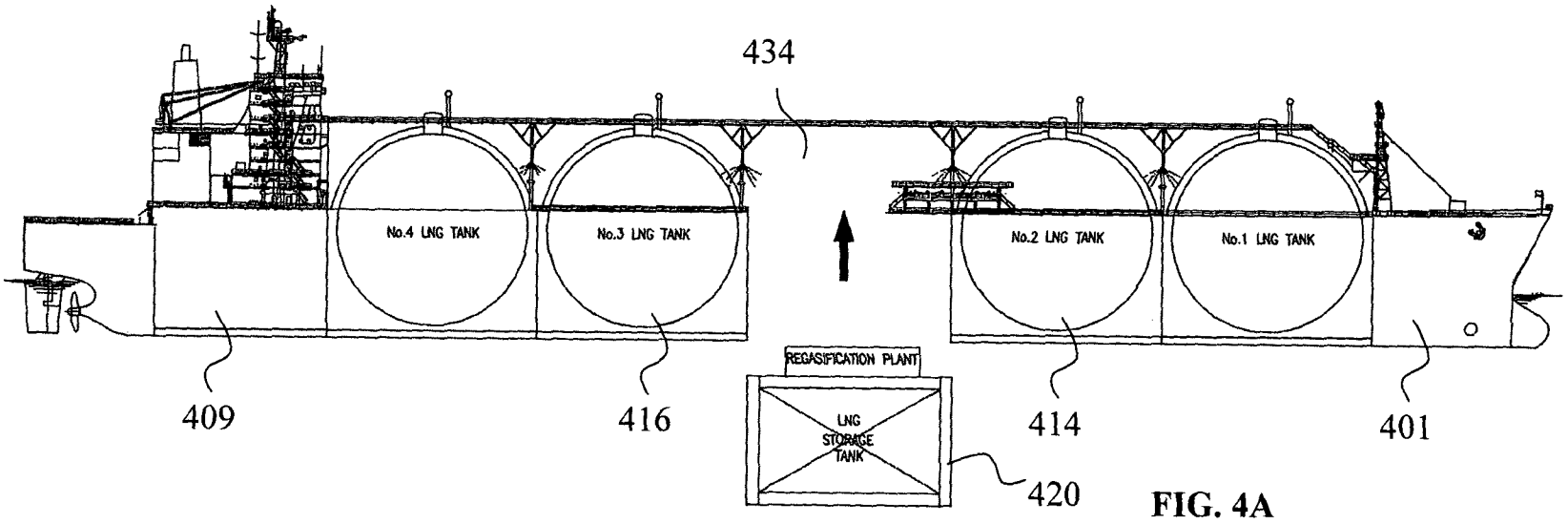
FIG. 4A is a partial cross sectional side view showing construction of an LNG carrier using an existing LNG carrier of FIG. 1A according to an alternative embodiment of the present invention.
Figure 4B:
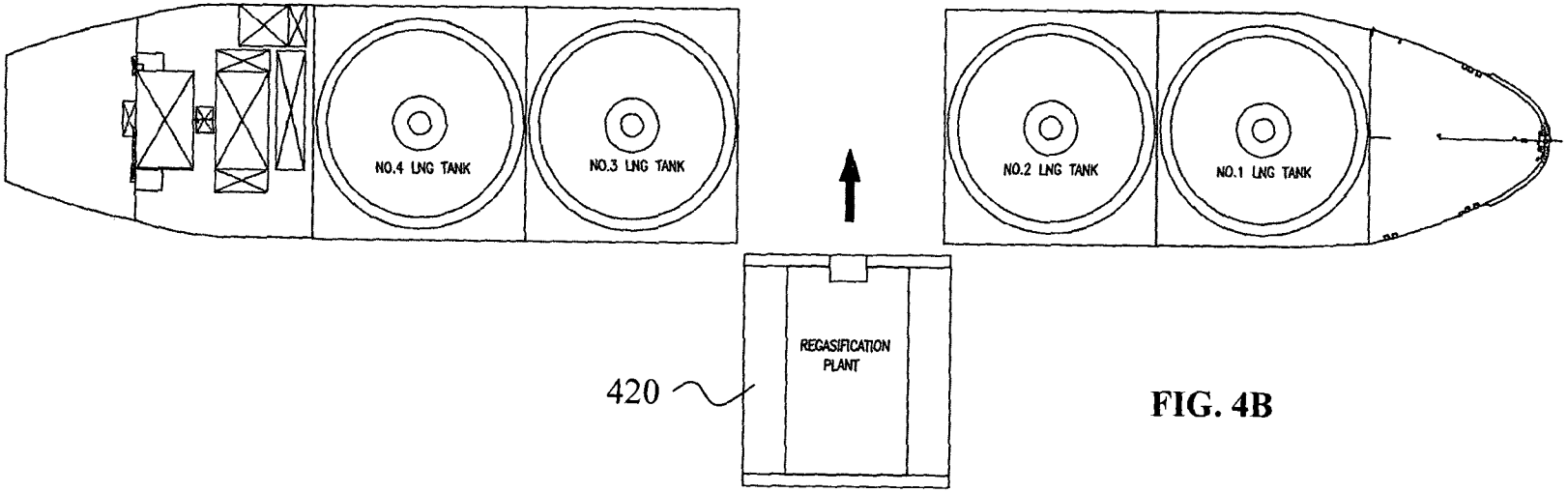
FIG. 4B is a partial top view of FIG. 4A.
Figure 4C:
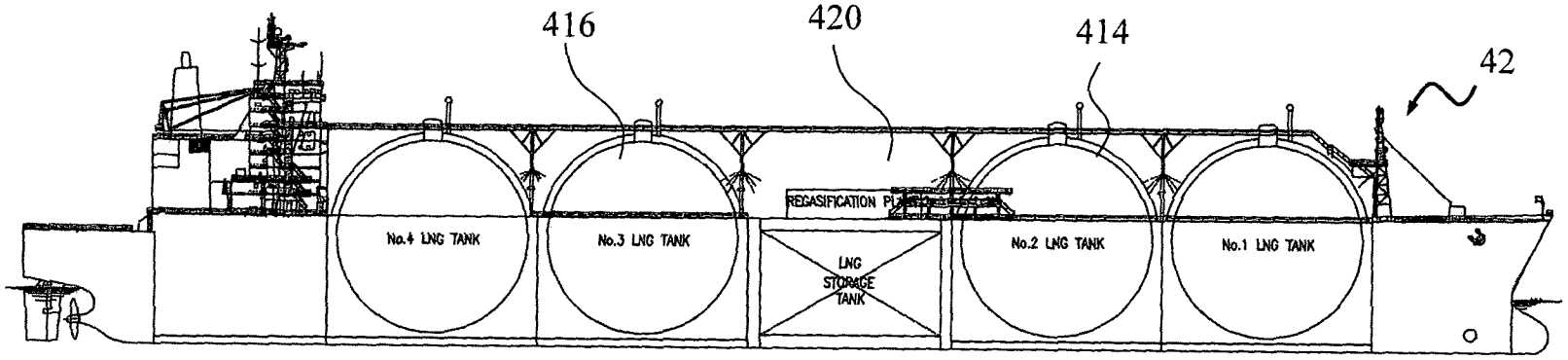
FIG. 4C is a partial cross sectional side view of an LNG carrier constructed according to the method shown in FIGS. 4A and 4B.
Figure 4D:
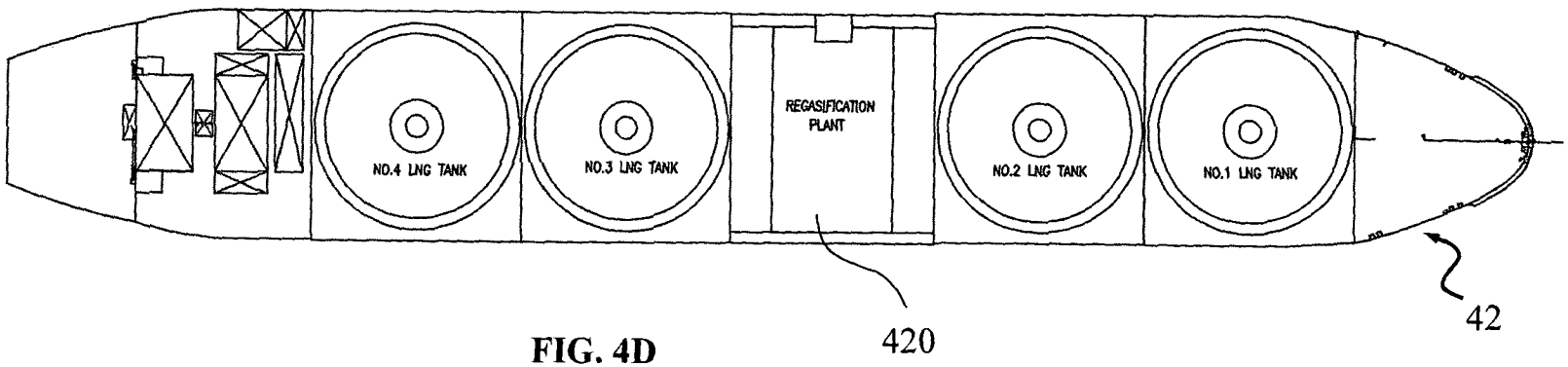
FIG. 4D is a partial top view of FIG. 4C.
Figure 5A:
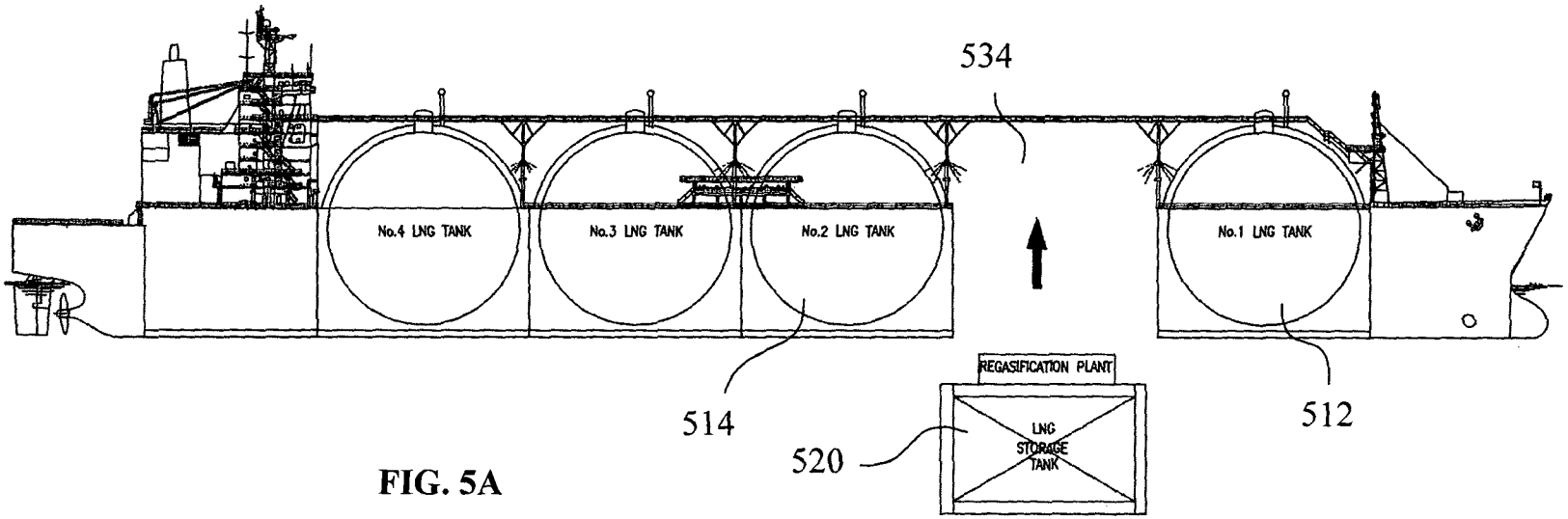
FIG. 5A is a partial cross sectional side view showing construction of an LNG carrier using an existing LNG carrier of FIG. 1A according to an alternative embodiment of the present invention.
Figure 5B:
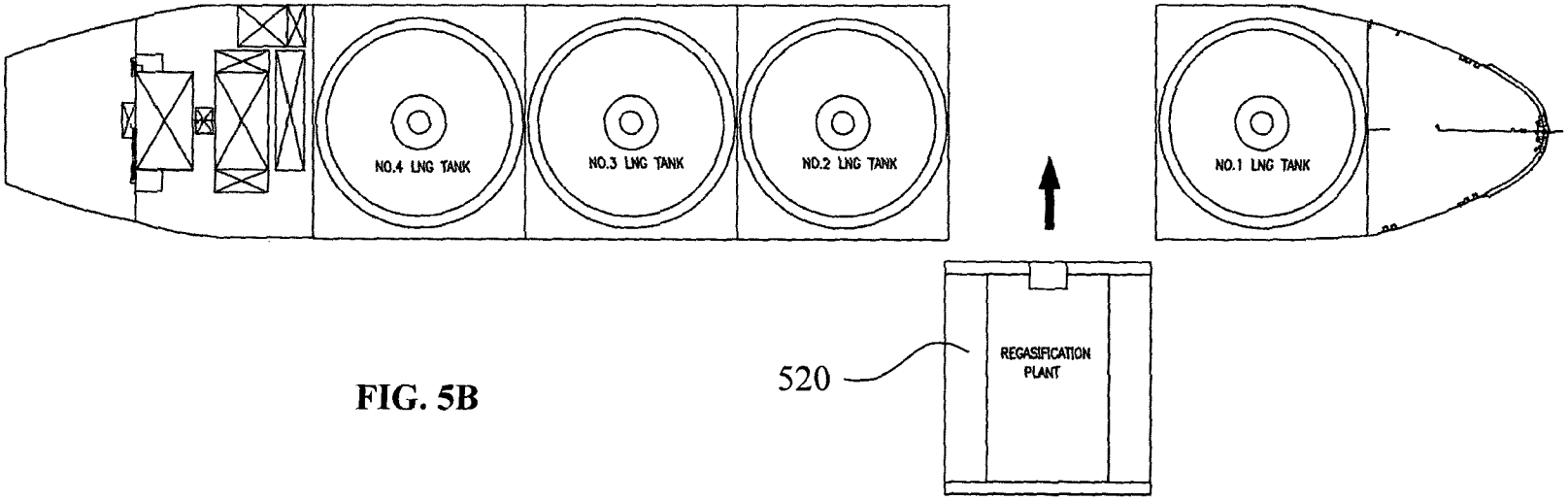
FIG. 5B is a partial top view of FIG. 5A.
Figure 5C:
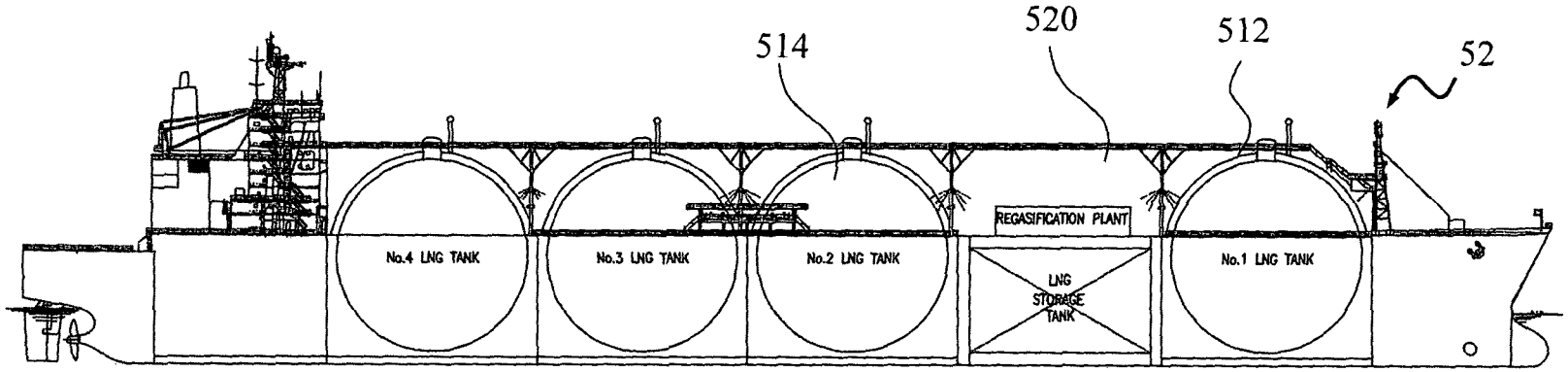
FIG. 5C is a partial cross sectional side view of an LNG carrier constructed according to the method shown in FIGS. 5A and 5B.
Figure 5D:
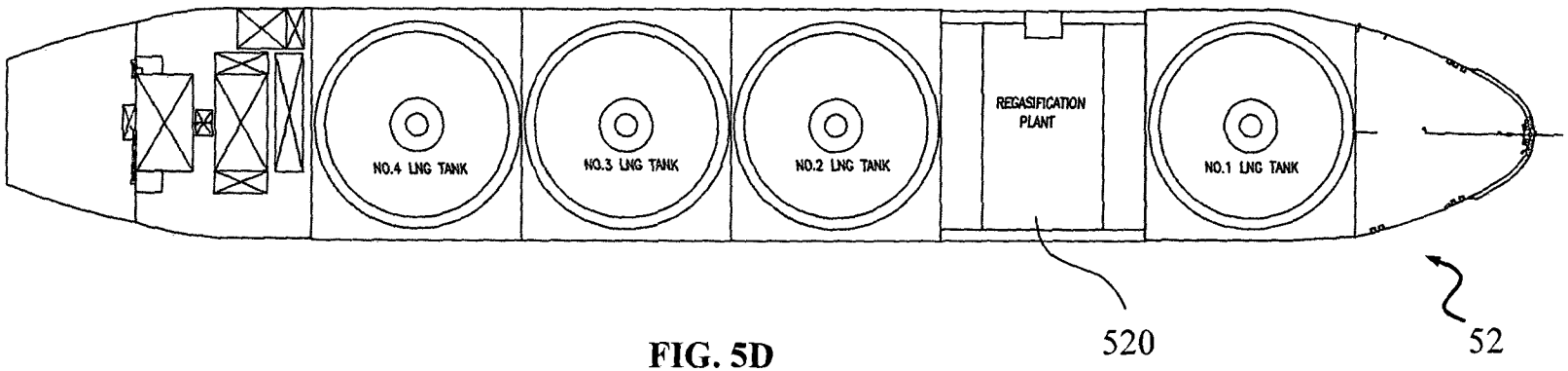
FIG. 5D is a partial top view of FIG. 5C.

According to another embodiment, an existing vessel may be separated into forward and aft sections at a different location, for integration of a structural block therebetween. As shown in FIGS. 3A, 3B, 3C and 3D, an existing vessel 30 is cut apart into a forward section 332 and an aft section 336. Cutting is performed between a third LNG tank 316 and a fourth LNG tank 318, hence the forward section 332 includes the bow 301, first, second and third LNG tanks 312, 314 and 316. The aft section 336 includes fourth tank 318 and the stern 309. A prefabricated structural block 320 e.g. a regasification plant, an LNG storage tank or a combination thereof, is then placed into the space 334 formed between forward section 332 and aft section 336, and jointed to forward and aft sections 332, 336 to form a new integrated vessel 32 with the structural block 320 integrated to the existing LNG carrier, as shown in FIGS. 3C and 3D.

Figure 6A:
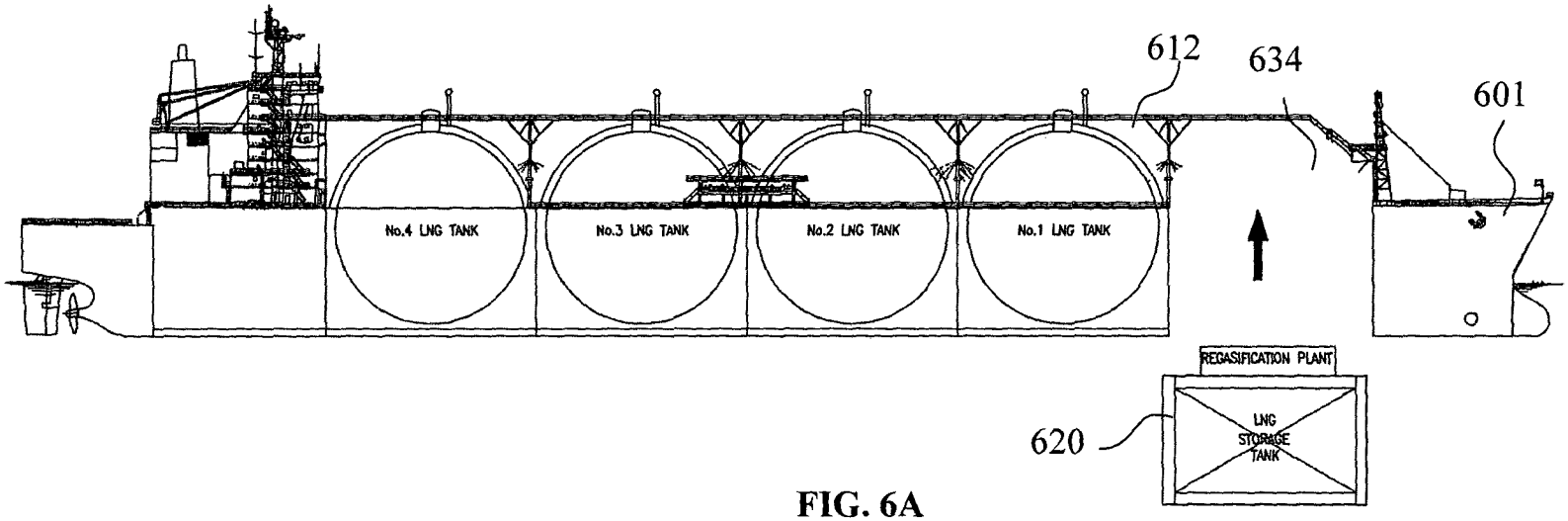
FIG. 6A is a partial cross sectional side view showing construction of an LNG carrier using an existing LNG carrier of FIG. 1A according to an alternative embodiment of the present invention.
Figure 6B:
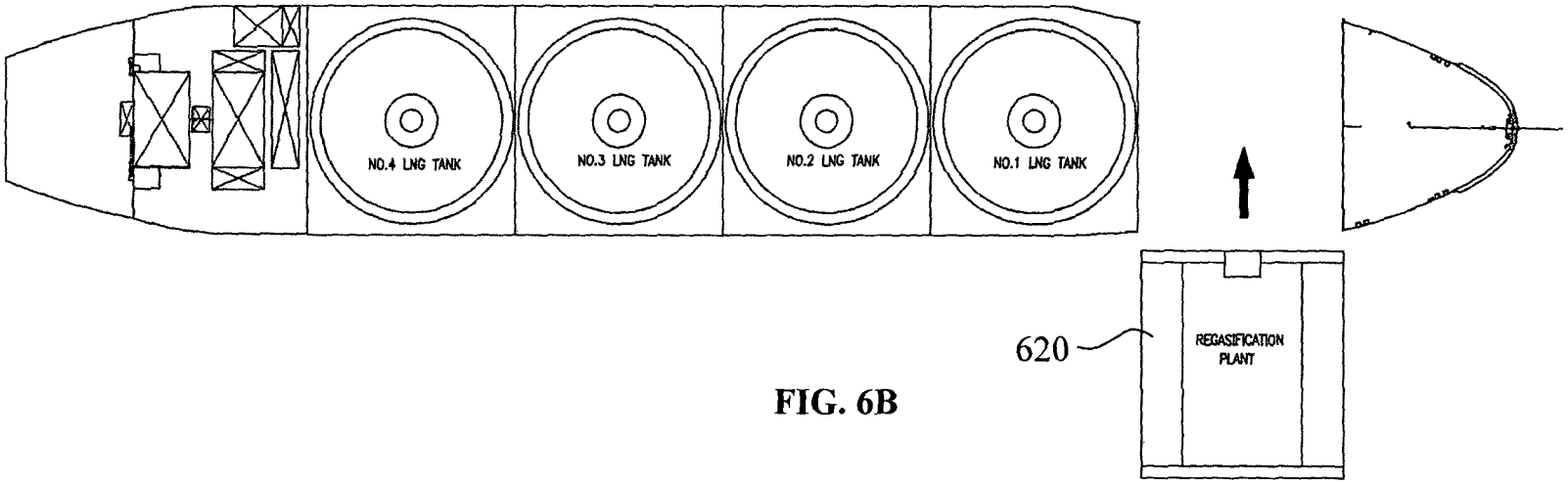
FIG. 6B is a partial top view of FIG. 6A.
Figure 6C:
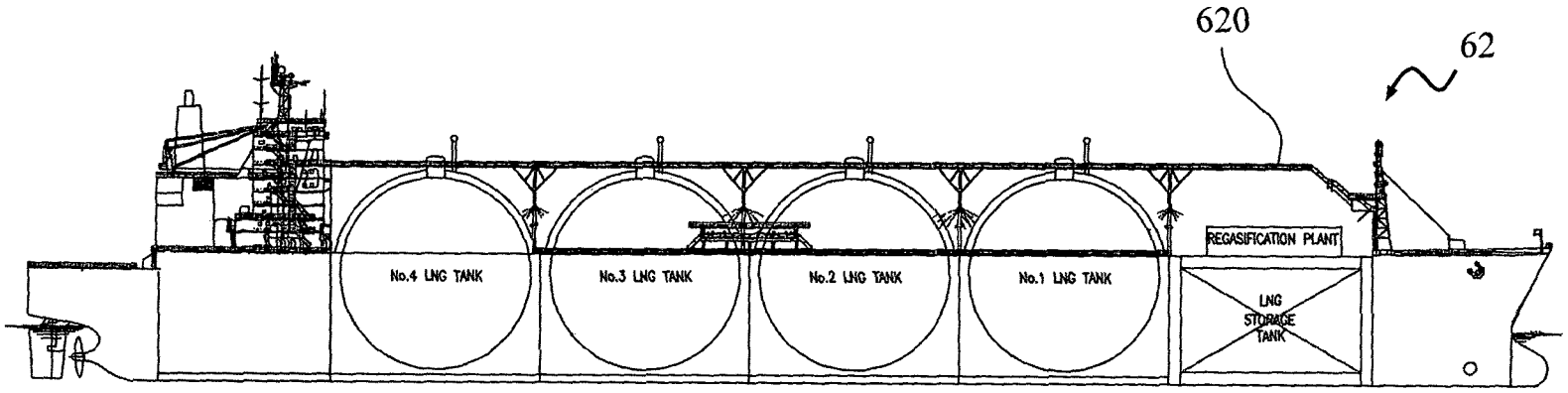
FIG. 6C is a partial cross sectional side view of a LNG carrier constructed according to the method shown in FIGS. 6A and 6B.
Figure 6D:
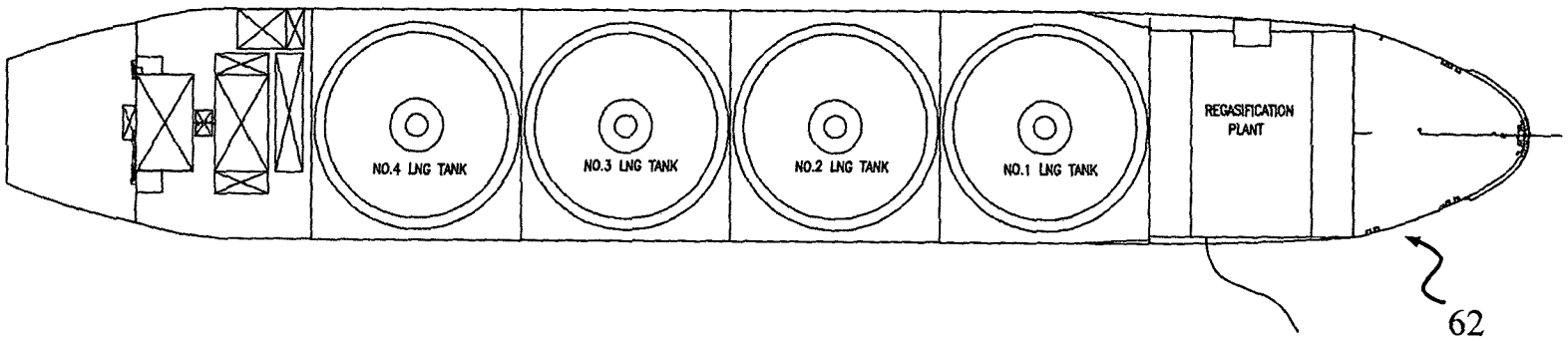
FIG. 6D is a partial top view of FIG. 6C.
Figure 7A:
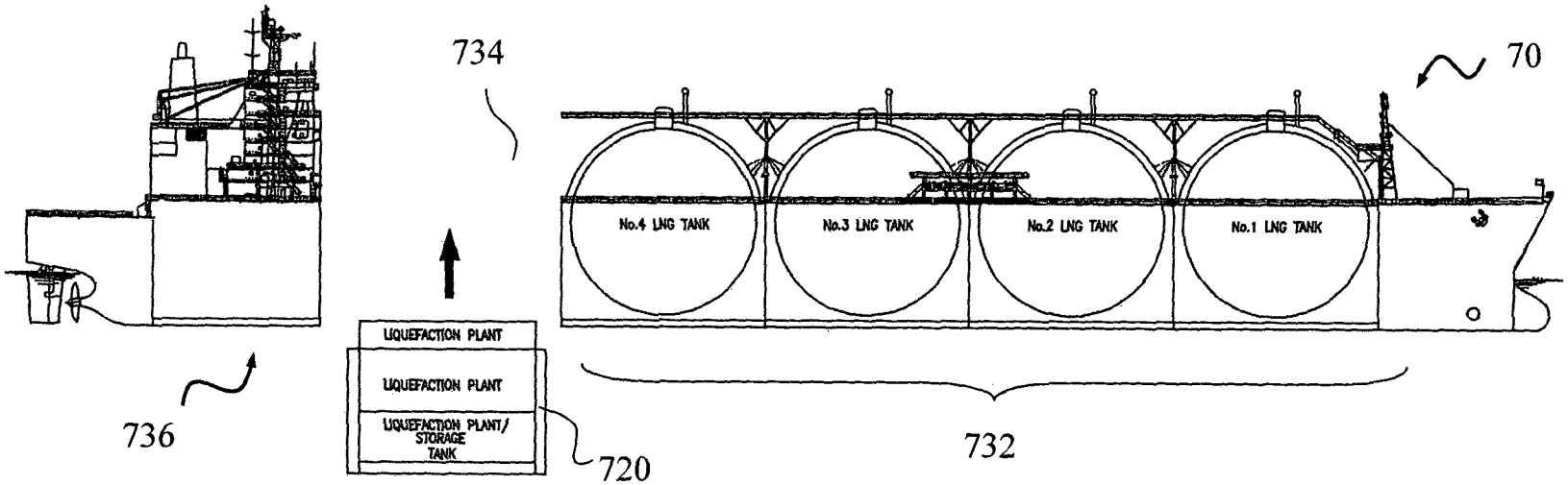
FIG. 7A is a partial cross sectional side view showing construction of an LNG carrier using an existing LNG carrier of FIG. 1A according to a further embodiment of the present invention.
Figure 7B:
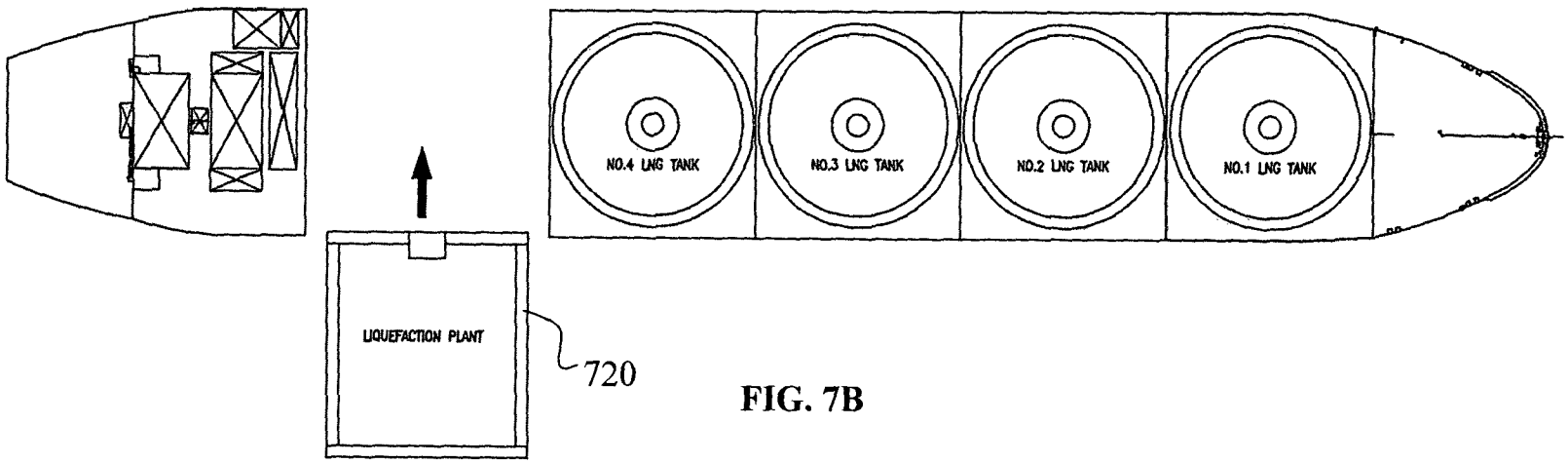
FIG. 7B is a partial top view of FIG. 7A.
Figure 7C:
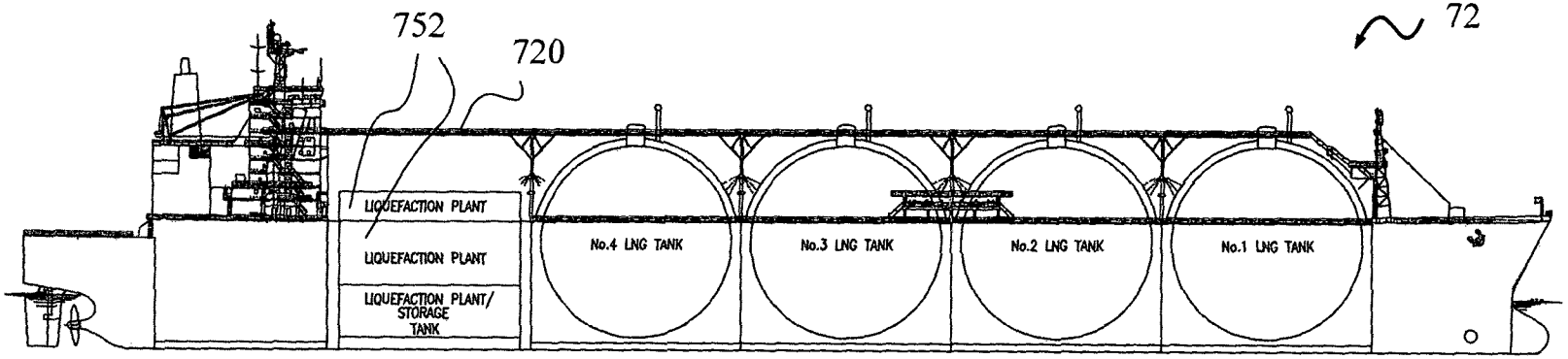
FIG. 7C is a partial cross sectional side view of an LNG carrier constructed according to the method shown in FIGS. 7A and 7B.
Figure 7D:
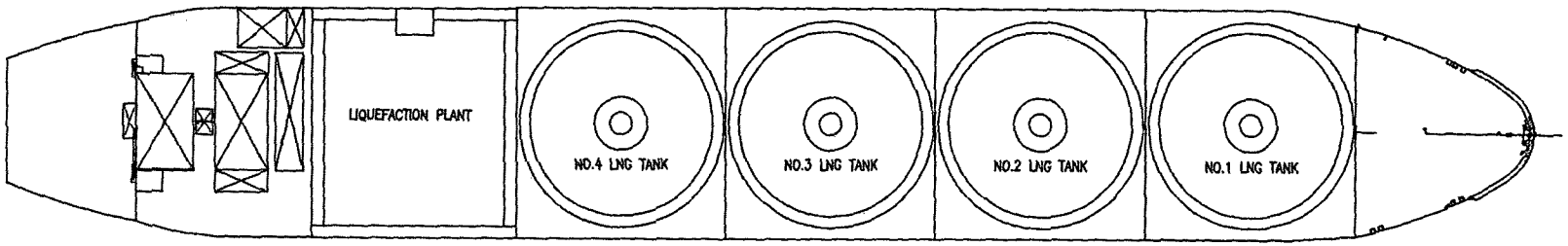
FIG. 7D is a partial top view of FIG. 7C.
Figures 8A, 8B:
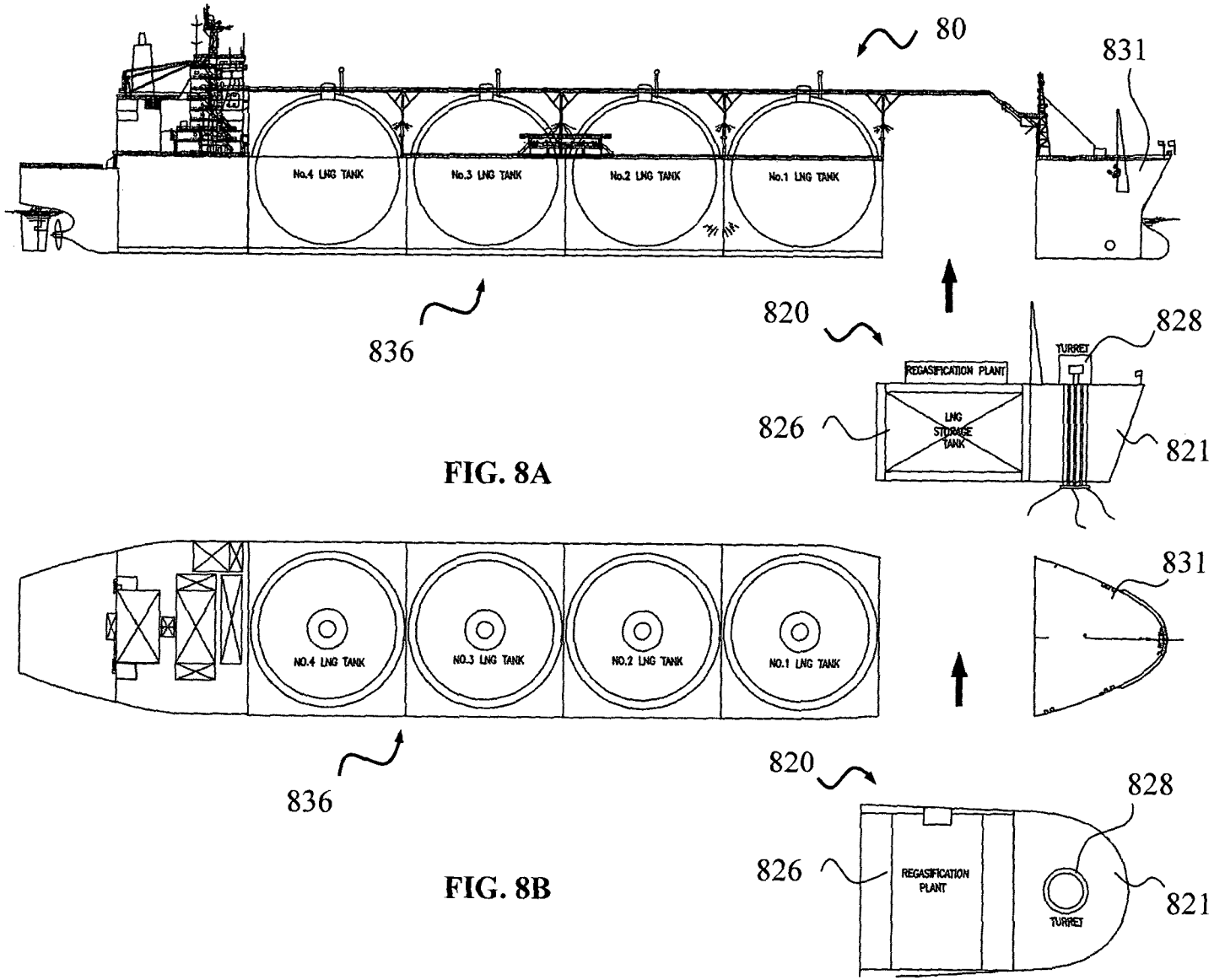
FIG. 8A is a partial cross sectional side view showing construction of an LNG carrier using an existing LNG carrier according to a still further embodiment of the present invention.
FIG. 8B is a partial top view of FIG. 8A.
Figures 8C, 8D:
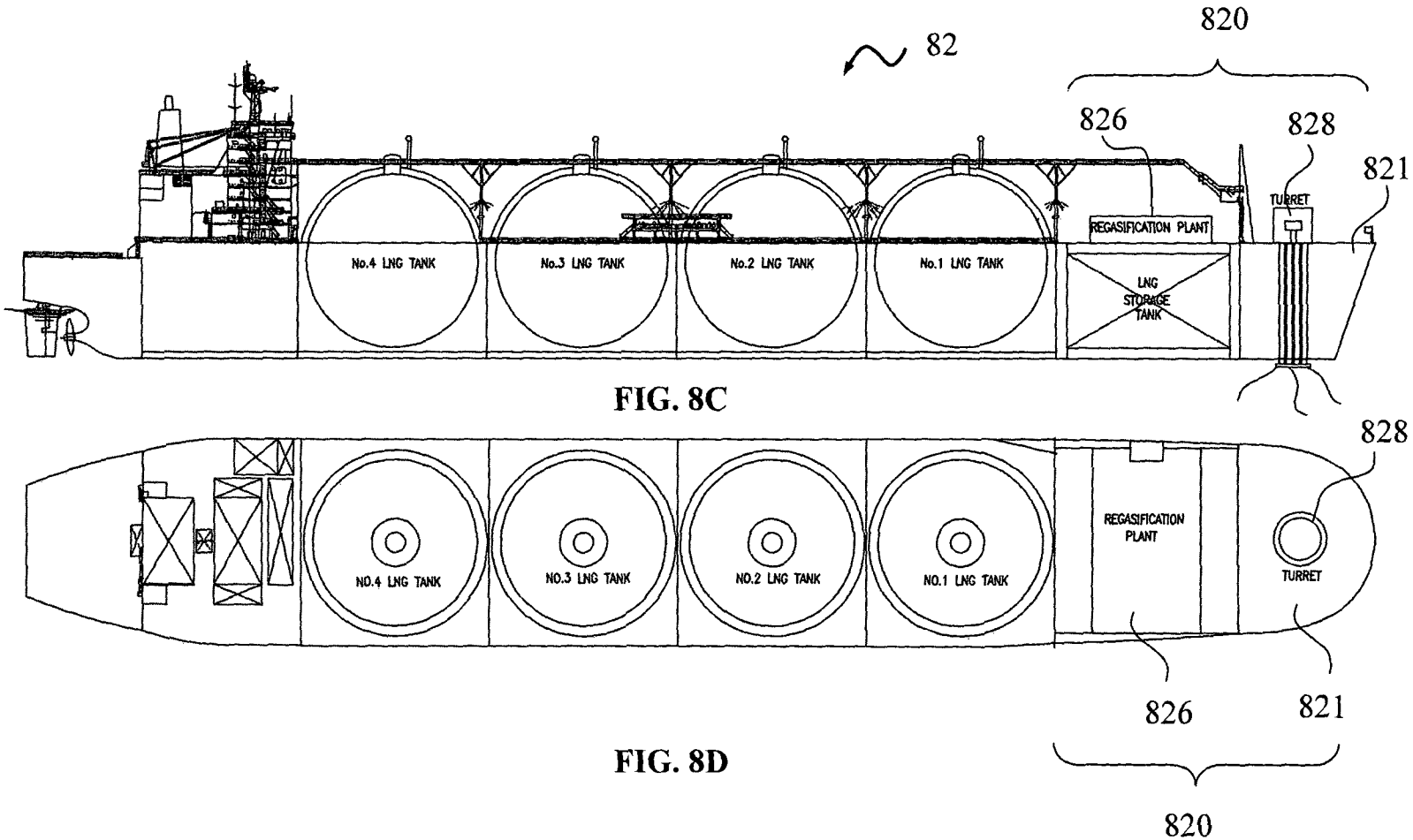
FIG. 8C is a partial cross sectional side view of an LNG carrier constructed according to the method shown in FIGS. 8A and 8B.
FIG. 8D is a partial top view of FIG. 8C.
Figures 9A, 9B:
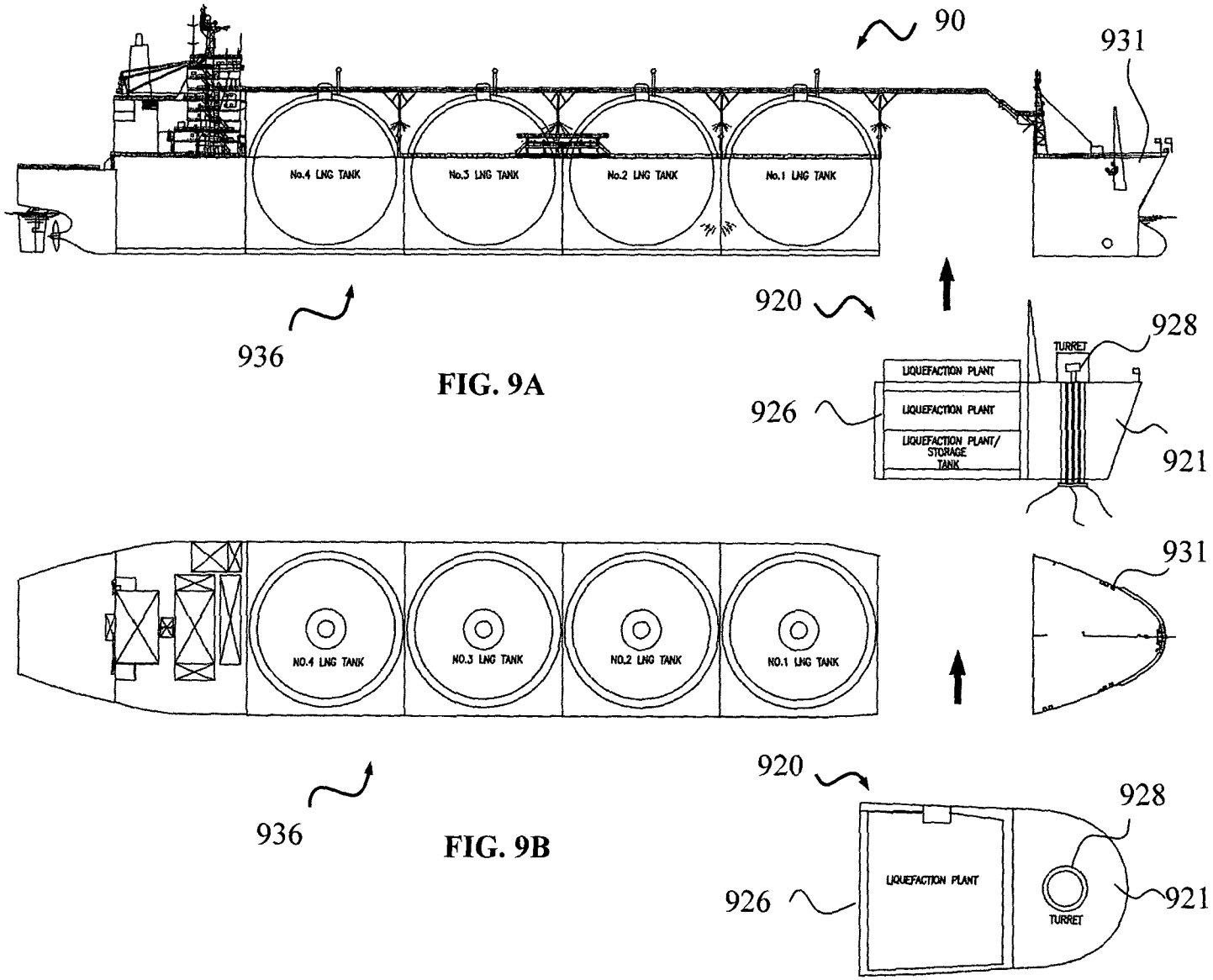
FIG. 9A is a partial cross sectional side view showing construction of an LNG carrier using an existing LNG carrier according to another further embodiment of the present invention.
FIG. 9B is a partial top view of FIG. 9A.
Figure 9C:
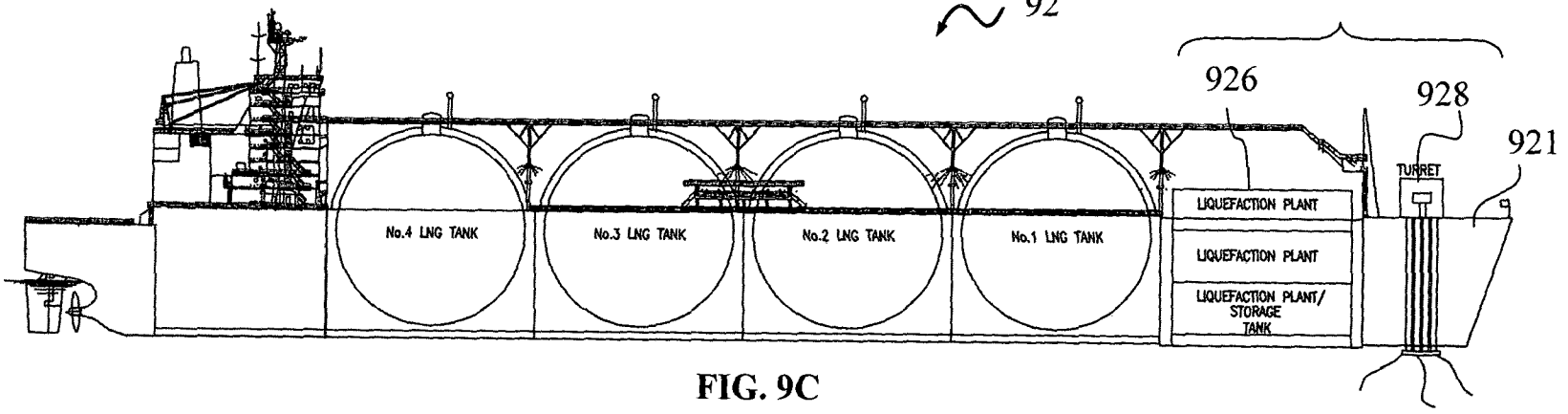
FIG. 9C is a partial cross sectional side view of an LNG carrier constructed according to the method shown in FIGS. 9A and 9B.
Figure 9D:
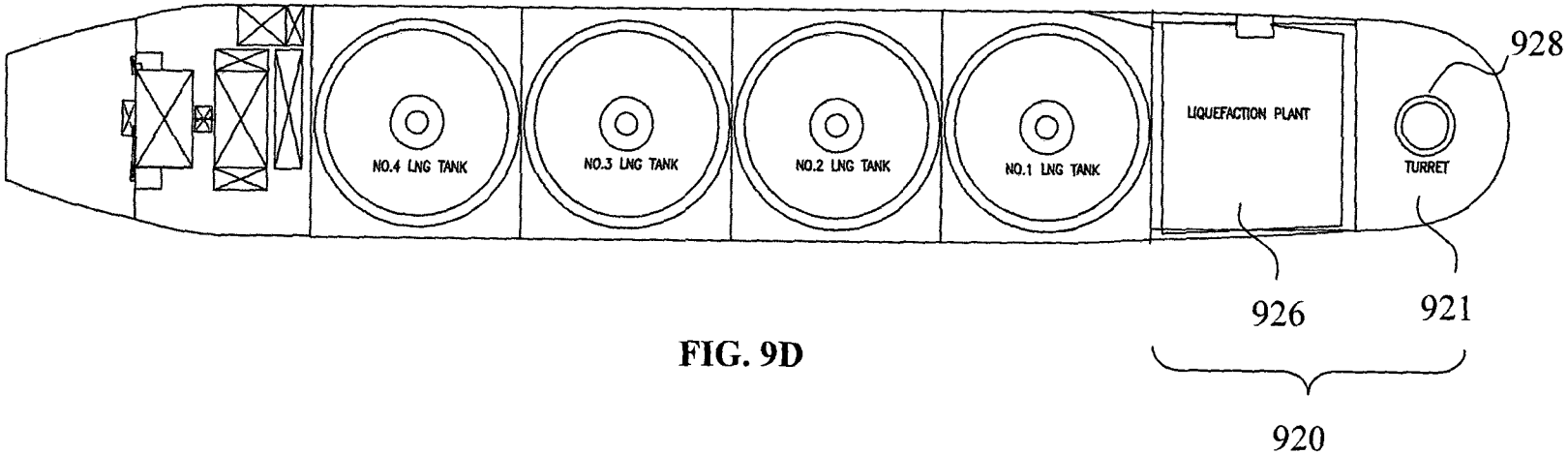
FIG. 9D is a partial top view of FIG. 9C.
Figures 10A, 10B:
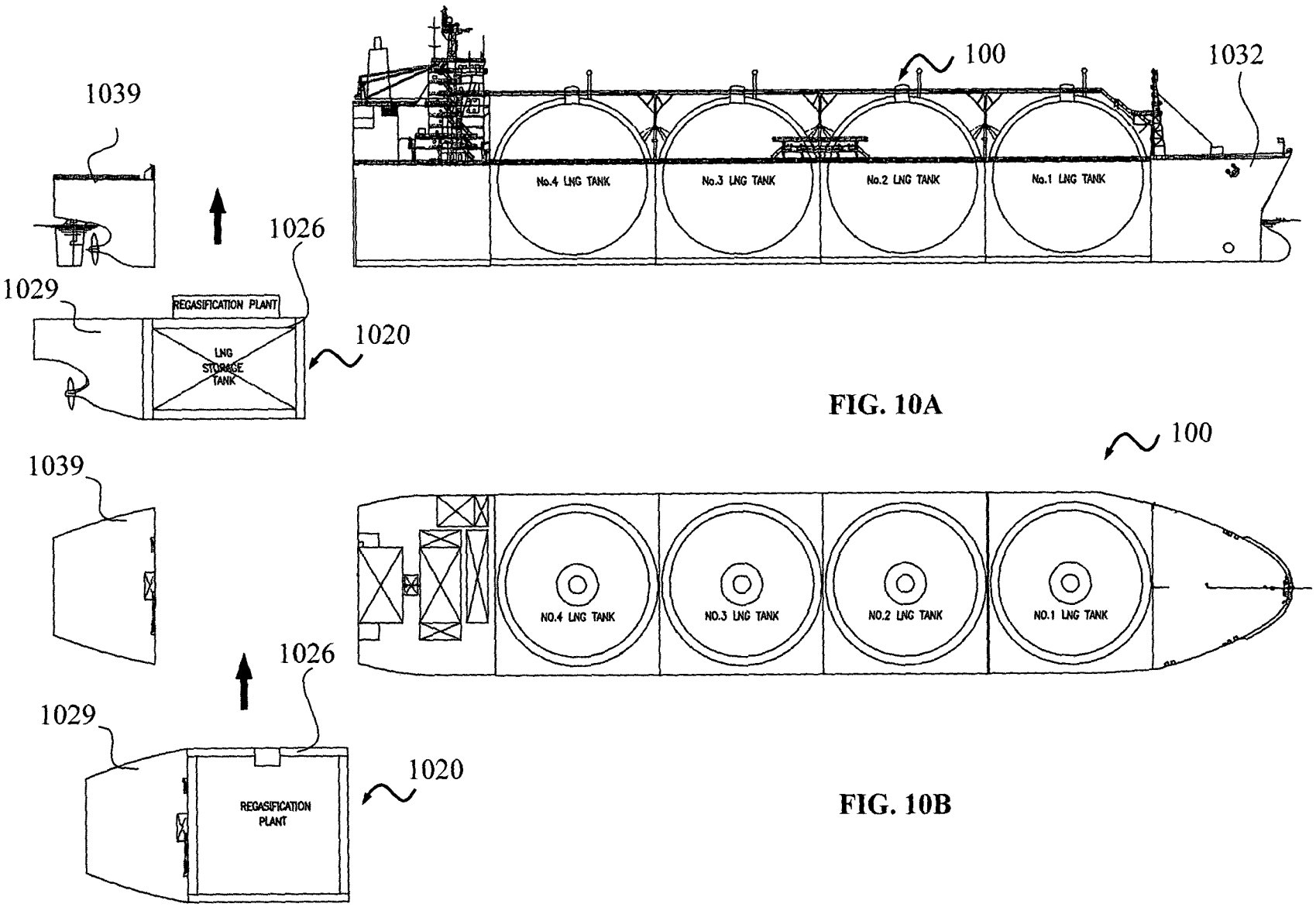
FIG. 10A is a partial cross sectional side view showing construction of an LNG carrier using an existing LNG carrier according to another further embodiment of the present invention.
FIG. 10B is a partial top view of FIG. 10A.
Figure 10C:
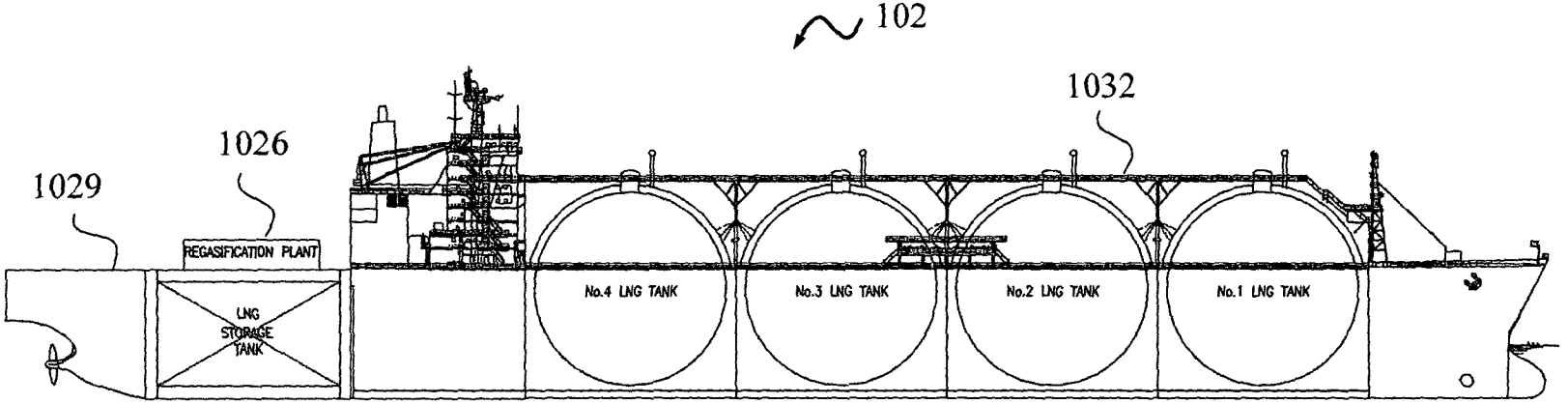
FIG. 10C is a partial cross sectional side view of an LNG carrier constructed according to the method shown in FIGS. 10A and 10B.
Figure 10D:
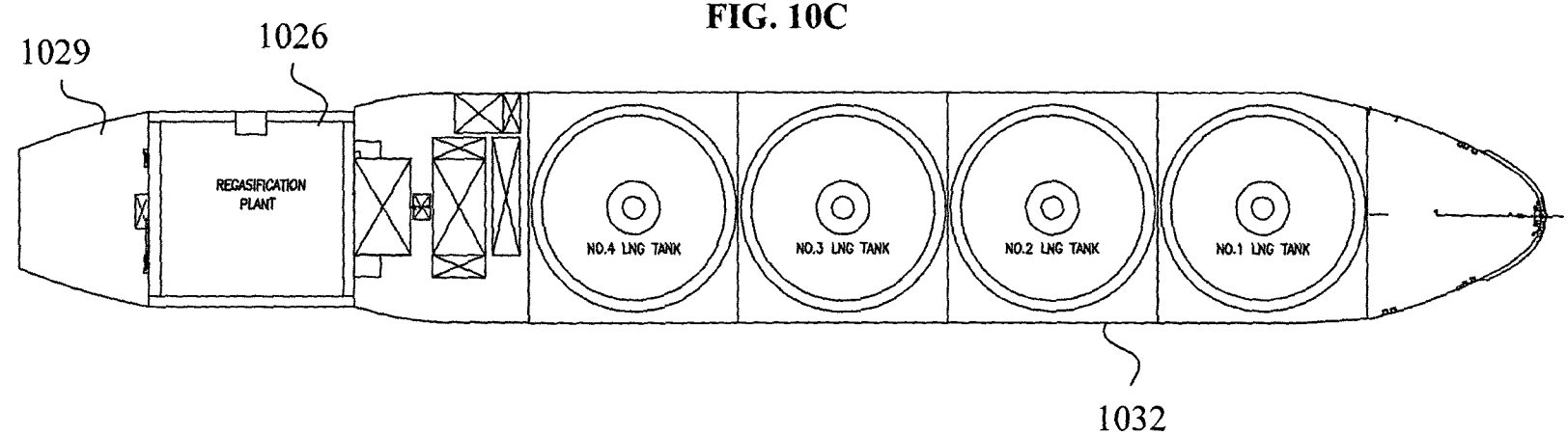
FIG. 10D is a partial top view of FIG. 10C.
Figure 11A:
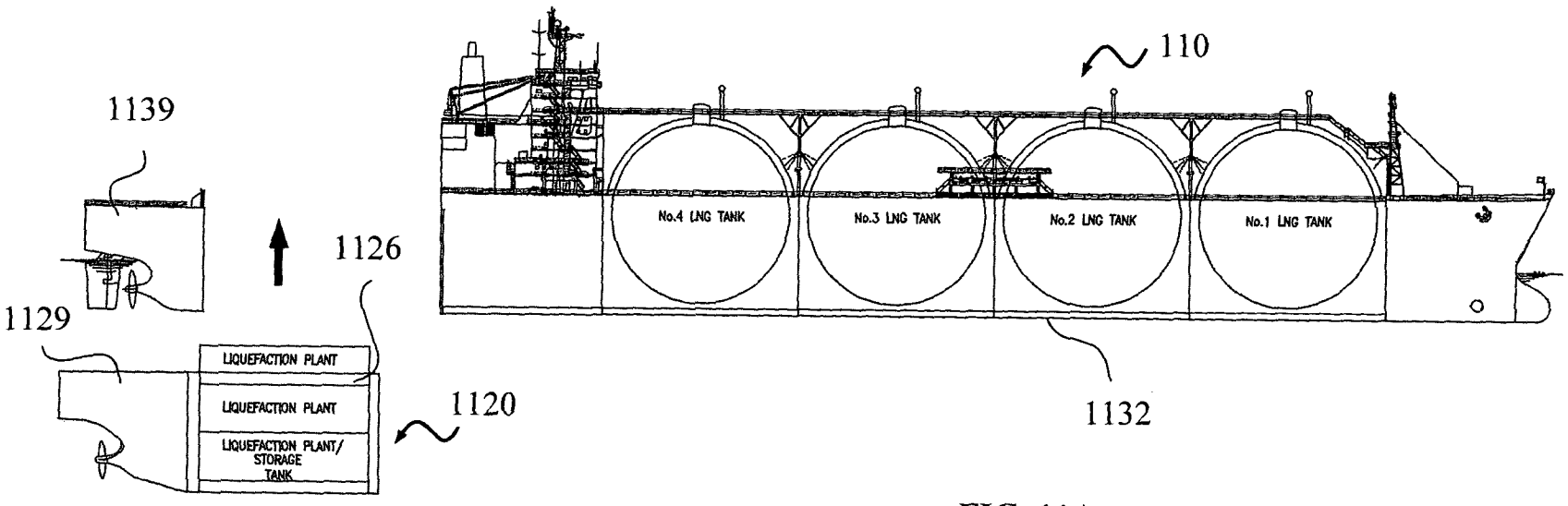
FIG. 11A is a partial cross sectional side view showing construction of an LNG carrier using an existing LNG carrier according to another further embodiment of the present invention.
Figure 11B:
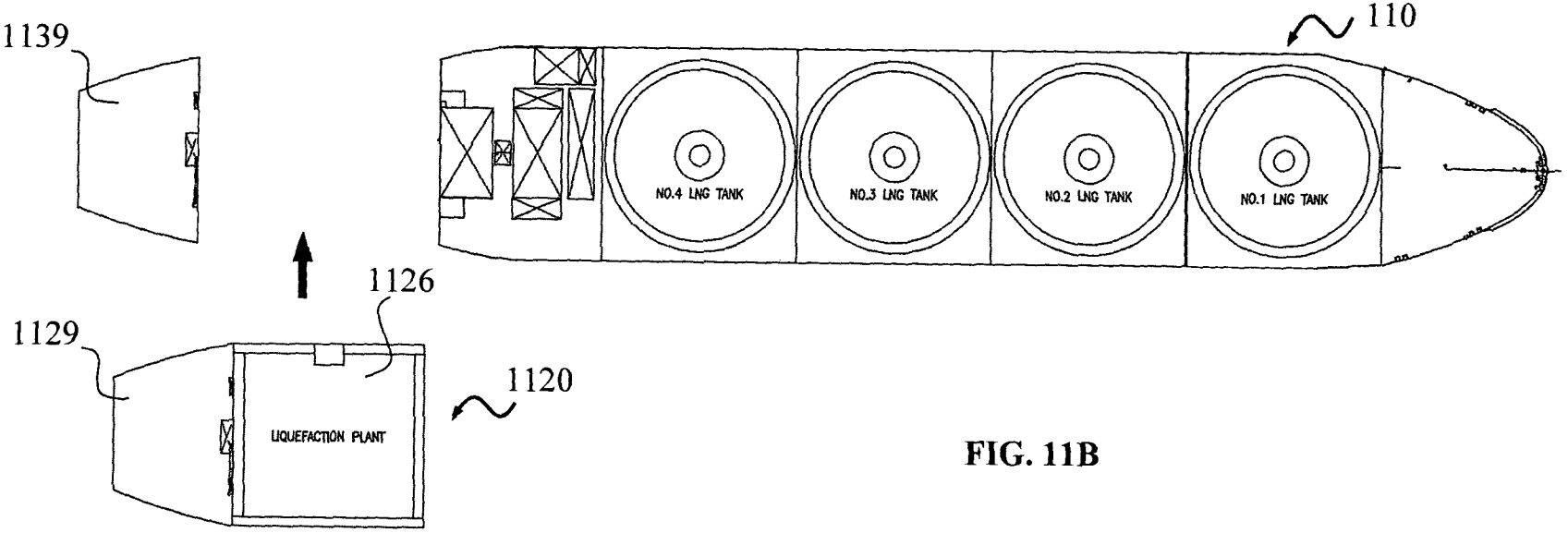
FIG. 11B is a partial top view of FIG. 11A.
Figure 11C:
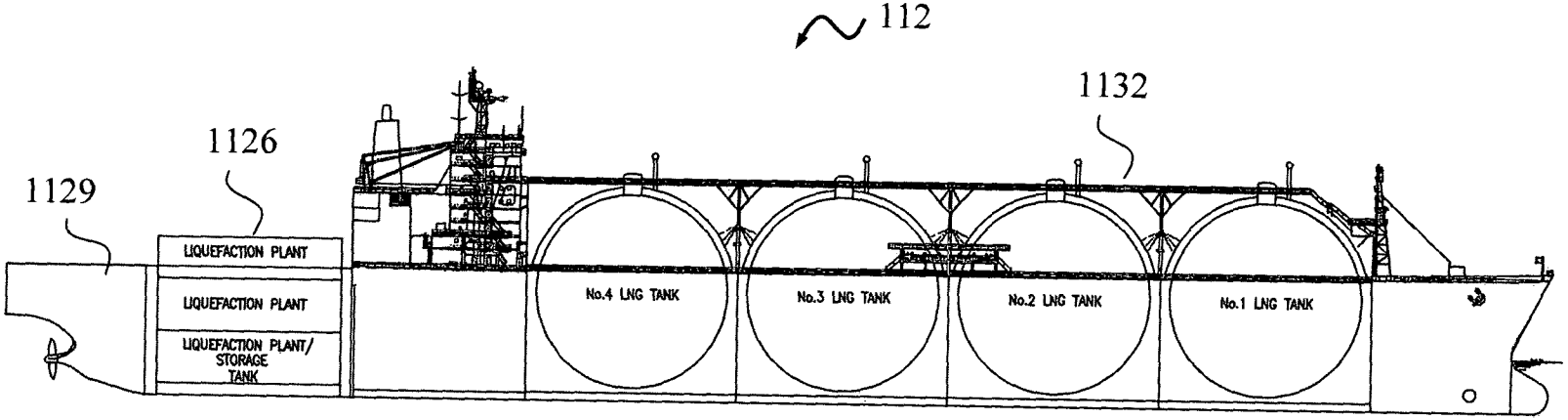
FIG. 11C is a partial cross sectional side view of an LNG carrier constructed according to the method shown in FIGS. 11A and 11B.
Figure 11D:
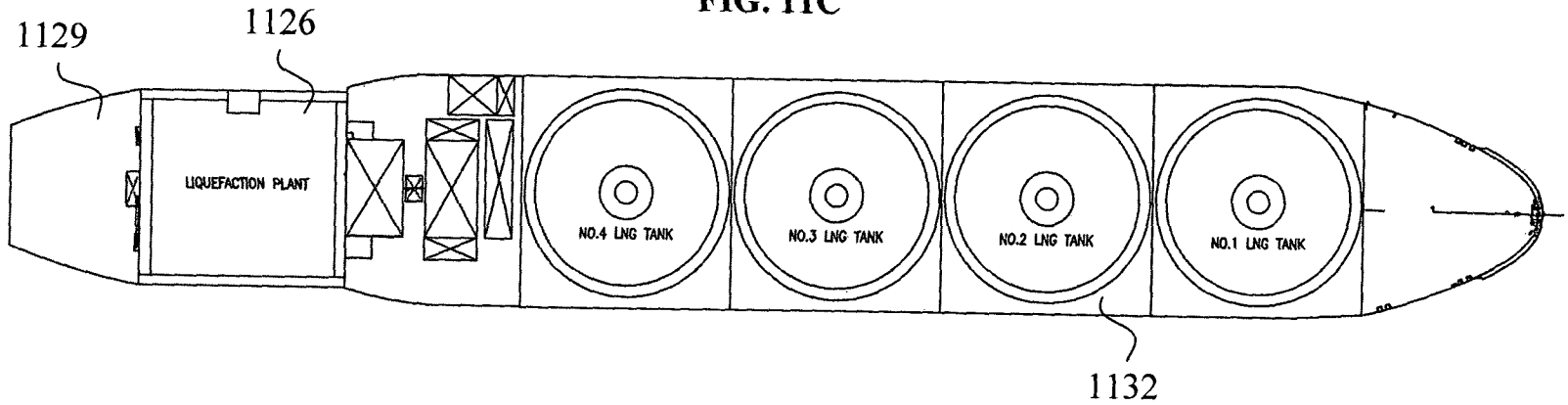
FIG. 11D is a partial top view of FIG. 11C.

Alternatively, as shown in respective FIGS. 4A to 4D, 5A to 5D and 6A to 6D, an existing vessel 40, 50, 60 may be cut apart at amidship section (between a second LNG tank 414 and third LNG tank 416, FIGS. 4A and 4B), a forward section (between a first LNG tank 512 and second LNG tank 514, FIGS. 5A and 5B) or a forward bow section (between bow 601 and first LNG tank 612, FIGS. 6A and 6B). A prefabricated structural block 420, 520, 620 is then placed at the space 434, 534, 634 formed by the cutting of the existing vessel, joining with the cut-apart forward and aft sections of the existing vessel and form integrated new vessel 42 (FIGS. 4C, 4D), 52 (FIGS. 5C, 5D) or 62 (FIGS. 6C, 6D).

In a further embodiment, as shown in FIGS. 7A to 7D, a prefabricated structural block 720 may include a liquefaction plant and/or one or more LNG storage tanks. An existing LNG carrier 70, is cut apart into a forward section 732 and an aft section 736, forming a space 734 therebetween. Structural block 720 is then placed in space 734 and joint to forward and aft sections 732, 736 to form a new LNG carrier 72 which has a liquefaction facility integrated into an existing LNG carrier. Similar to previous embodiments, cutting of existing vessel may be performed at various different locations of the hull, based on actual requirements, and integrate the structural block at these locations. In the case that no LNG storage tank is installed, one or more intermediate structural decks 752 can be installed inside of the new structural block to form deck space for machinery, gas/LNG processing plants, or other purposes.

In a further embodiment shown in FIGS. 8A to 8D, a prefabricated structural block 820 includes a new bow 821 and a regasification plant and/or one or more LNG storage tanks 826. A first existing LNG carrier 80, is cut apart into a forward section 831 and an aft section 836. Forward section 831 is a bow of first existing LNG carrier 80. After cutting the first existing LNG carrier 80, the forward section 831 (in this case, the bow) is removed and the structural block 820 is joint to aft section 836 to form a new LNG carrier 82 which has a regasification facility integrated into first existing LNG carrier 80, together with the new bow 821.

Structural block 820 may also include a turret 828 built on bow 821. Turret 828 provides a non-rotating platform for supporting the mooring lines and flexible risers dedicated for gas export/import and associated control/service lines.

Either one or both the bow 821/turret 828 and the LNG storage tanks/regasification plant 826 may be obtained from a second existing LNG carrier/regasification plant, or built from sketch.

In another further embodiment shown in FIGS. 9A to 9D, a prefabricated structural block 920 includes a new bow 921 and a liquefaction plant and/or one or more LNG storage tanks 926. A first existing LNG carrier 90, is cut apart into a forward section 931 and an aft section 936. Forward section 931 is a bow of first existing LNG carrier 90. After cutting the first existing LNG carrier 90, the forward section 931 (in this case, the bow) is removed and the structural block 920 is joint to aft section 936 to form a new LNG carrier 92 which has a liquefaction facility integrated into first existing LNG carrier 90, together with the new bow 921.

Structural block 920 may also include a turret 928 built on new bow 921. Turret 928 provides a non-rotating platform for supporting the mooring lines and flexible risers dedicated for gas export/import and associated control/service lines.

Either one or both the bow 921/turret 928 and the LNG storage tanks/liquefaction plant 926 may be obtained from a second existing LNG carrier/liquefaction plant, or built from sketch.

In another further embodiment shown in FIGS. 10A to 10D, a prefabricated structural block 1020 includes a stern 1029 and a regasification plant and/or one or more LNG storage tanks 1026. A first existing LNG carrier 100, is cut apart into a forward section 1032 and an aft section 1039. Aft section 1039 is a stern of first existing LNG carrier 100. After cutting the first existing LNG carrier 100, the aft section 1039 (in this case, the stern) is removed and the structural block 1020 is joint to forward section 1032 to form a new LNG carrier 102 which has a regasification facility integrated into first existing LNG carrier 100, together with the new stern 1029.

Either one or both the stern 1029 and the LNG storage tanks/regasification plant 1026 may be obtained from a second existing LNG carrier/regasification plant, or built from sketch.

In another further embodiment shown in FIGS. 11A to 11D, a prefabricated structural block 1120 includes a stern 1129 and, a liquefaction plant and/or one or more LNG storage tanks 1126. A first existing LNG carrier 110 is cut apart into a forward section 1132 and an aft section 1139. Aft section 1139 is a stern of first existing LNG carrier 110. After cutting the first existing LNG carrier 110, the aft section 1139 (in this case, the stern) is removed and the structural block 1120 is joint to forward section 1132 to form a new LNG carrier 112 which has a liquefaction facility integrated into first existing LNG carrier 110, together with the new stern 1129.

Either one or both the stern 1129 and the LNG storage tanks/liquefaction plant 1126 may be obtained from a second existing LNG carrier/liquefaction plant, or built from sketch.

Although embodiments of the present invention have been illustrated in conjunction with the accompanying drawings and described in the foregoing detailed description, it should be appreciated that the present invention is not limited to the embodiments disclosed. Therefore, the present invention should be understood to be capable of numerous rearrangements, modifications, alternatives and substitutions without departing from the spirit of the invention as set forth and recited by the following claims.

The invention claimed is:

1. A method for constructing an FLNG, FSRU or a LNG carrier, the method comprising:

separating a first existing LNG carrier to form a forward section and an aft section;

placing a structural block into a space between the forward section and the aft section, the structural block having a front end and a rear end;

joining the forward section to the front end of the structural block and joining the aft section to the rear end of the structural block to form a new integrated vessel with additional deck space, the structural block having been fabricated prior to separating the first existing LNG carrier, wherein the structural block includes a gas process facility disposed on the additional deck space, and the gas process facility includes a regasification plant or a liquefaction plant.

2. The method of claim 1, wherein the structural block includes one or more LNG storage tanks.

3. The method of claim 2, wherein the LNG storage tank is selected from a group consisting of a MOSS type tank, a Gaztransport & Technigaz (GTT) tank, a self-supporting prismatic type B (SPB) tank, an independent type A tank and an independent type C tank.

4. The method of claim 1, wherein the structural block is fabricated at a first site and the separating of the first existing LNG carrier is carried out at a second site, wherein the first site and the second site are independently operable from each other.

5. The method of claim 1, wherein the structural block is fabricated at a site while the first existing LNG carrier is absent from the site.

6. The method of claim 1, wherein the structural block is a structure section of a second existing LNG carrier.

7. The method of claim 1 further comprising, prior to separating the first existing LNG carrier, determining characteristics of the first existing LNG carrier for fabrication of the structural block fabrication.

8. A method for constructing an FLNG, FSRU or a LNG carrier, the method comprising:

separating a first existing LNG carrier to form a forward section and an aft section;

joining a structural block with one of the forward section and the aft section to form a new integrated vessel with additional deck space, the structural block having been fabricated prior to separating the first existing LNG carrier, wherein the structural block includes a gas process facility disposed on the additional deck space, and the gas process facility includes a regasification plant or a liquefaction plant.

9. The method of claim 8, wherein the structural block includes one or more LNG storage tanks.

10. The method of claim 9, wherein the LNG storage tank is selected from a group consisting of a MOSS type tank, a Gaztransport & Technigaz (GTT) tank, a self-supporting prismatic type B (SPB) tank, an independent type A tank and an independent type C tank.

11. The method of claim 8, wherein the structural block is fabricated at a first site and the separating of the first existing LNG carrier is carried out at a second site, wherein the first site and the second site are independently operable from each other.

12. The method of claim 8, wherein the structural block is fabricated at a site while the first existing LNG carrier is absent from the site.

13. The method of claim 8, wherein the structural block is a structure section of a second existing LNG carrier.

14. The method of claim 8, wherein the structural block includes a bow section of a second LNG carrier, the forward section of the first existing LNG carrier is a bow of the first existing LNG carrier, and wherein the structural block is joined to the aft section of the first LNG carrier to form the new integrated LNG carrier.

15. The method of claim 14, wherein the structural block further includes a turret built on the bow section.

16. The method of claim 8, wherein the structural block includes a stern section of a second LNG carrier, the aft section of the first existing LNG carrier is a stern of the first existing LNG carrier, and wherein the structural block is joined to the forward section of the first LNG carrier to form the new integrated LNG carrier.

17. The method of claim 8 further comprising, prior to separating the first existing LNG carrier, determining characteristics of the first existing LNG carrier for fabrication of the structural block.

* * * * *